US007651194B2

(12) United States Patent
Yazawa et al.

(10) Patent No.: US 7,651,194 B2
(45) Date of Patent: Jan. 26, 2010

(54) PRINTING APPARATUS AND CONVEYANCE AMOUNT CORRECTION METHOD FOR THE SAME

(75) Inventors: Takeshi Yazawa, Yokohama (JP); Hiroshi Tajika, Yokohama (JP); Hitoshi Nishikori, Tokyo (JP); Daisaku Ide, Tokyo (JP); Atsuhiko Masuyama, Tokyo (JP); Akiko Maru, Kawasaki (JP); Hideaki Takamiya, Kawasaki (JP); Kosuke Yamamoto, Yokohama (JP); Masao Maeda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 464 days.

(21) Appl. No.: 11/204,072

(22) Filed: Aug. 16, 2005

(65) Prior Publication Data

US 2006/0044380 A1 Mar. 2, 2006

(30) Foreign Application Priority Data

Aug. 25, 2004 (JP) ..... 2004-245687

(51) Int. Cl.
*B41J 2/165* (2006.01)

(52) U.S. Cl. ..... 347/36

(58) Field of Classification Search ..... None
See application file for complete search history.

(56) References Cited

U.S. PATENT DOCUMENTS

| | | | | |
|---|---|---|---|---|
| 5,790,141 | A * | 8/1998 | Yamamoto | 347/15 |
| 6,231,155 | B1 * | 5/2001 | Udagawa et al. | 347/19 |
| 6,364,446 | B1 * | 4/2002 | Ishikawa et al. | 347/15 |
| 6,568,784 | B2 * | 5/2003 | Izumi et al. | 347/19 |
| 6,869,175 | B2 * | 3/2005 | Sinmmachi | 347/104 |
| 7,284,918 | B2 | 10/2007 | Nunokawa | |
| 2003/0007023 | A1 * | 1/2003 | Barclay et al. | 347/8 |

FOREIGN PATENT DOCUMENTS

| | | |
|---|---|---|
| JP | 06-238969 | 8/1994 |
| JP | 07-314788 | 5/1995 |
| JP | 2001-187471 | 7/2001 |
| JP | 2002-167064 | 6/2002 |
| JP | 2004-058526 | 2/2004 |
| JP | 2004-123313 | 4/2004 |

* cited by examiner

*Primary Examiner*—Stephen D Meier
*Assistant Examiner*—Alexander C Witkowski
(74) *Attorney, Agent, or Firm*—Fitzpatrick, Cella, Harper & Scinto

(57) ABSTRACT

In a printing apparatus which prints an image on a printing medium by alternately performing printing of an image on the printing medium by using a printing unit and conveyance of the printing medium relative to the printing unit, the conveyance amount in conveyance is corrected by using first and second parameters for correcting the conveyance amount in accordance with different factors. This makes it possible to correct the conveyance amount in accordance with the deviation of the printing position due to the different factors.

12 Claims, 24 Drawing Sheets

FIG. 12A
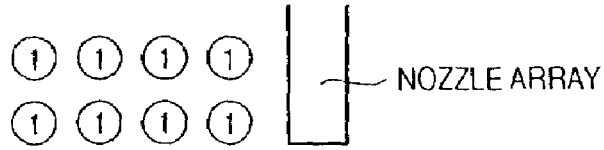
FIG. 12B
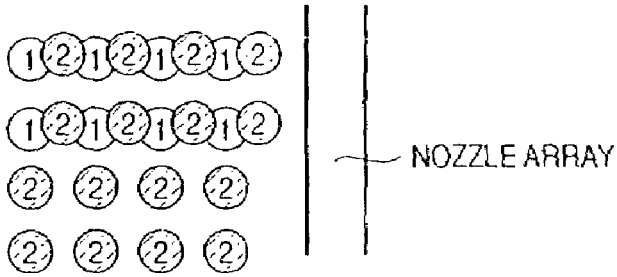
FIG. 12C
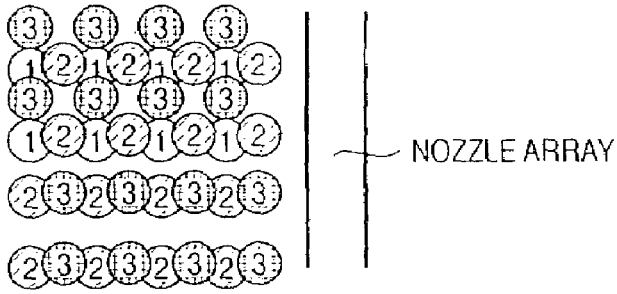
FIG. 12D
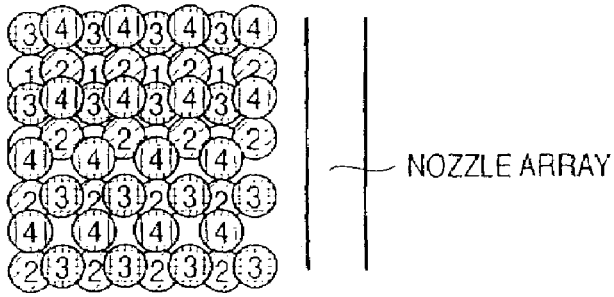
FIG. 12E →
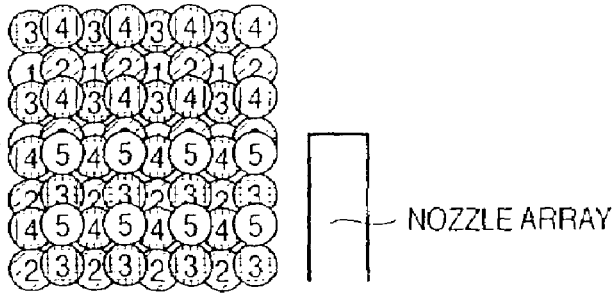

FIG. 13A
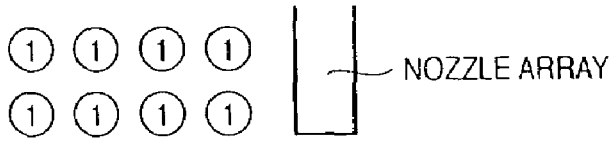
FIG. 13B
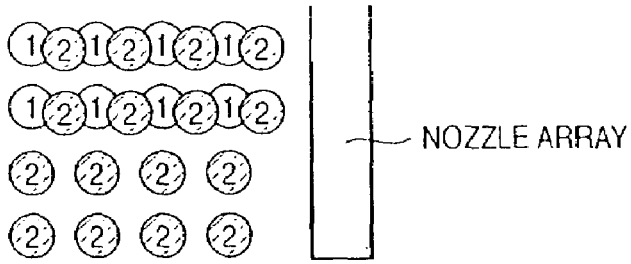
FIG. 13C
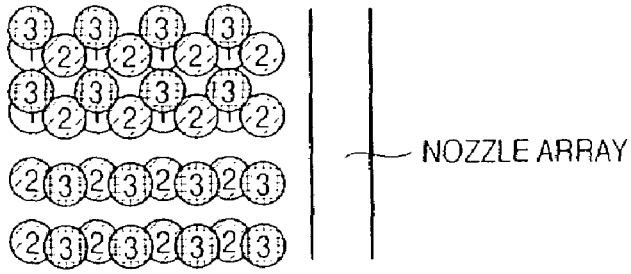
FIG. 13D
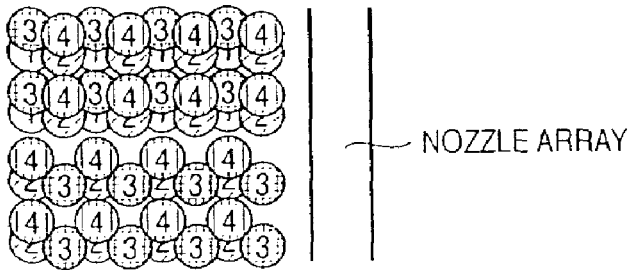
FIG. 13E →
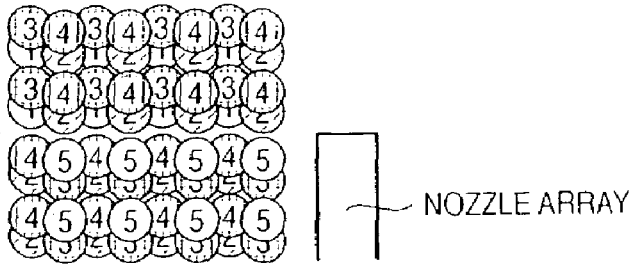

FIG. 15B

768nozzle 8pass

| (1) | (2) | (3) | (4) | (5) | (6) | (7) | (8) |
|---|---|---|---|---|---|---|---|
| 32 | | | | | | | |
| 32 | | | | | | | |
| 32 | | | | | | | |
| 32 | 32 | | | | | | |
| 32 | 32 | | | | | | |
| 32 | 32 | | | | | | |
| 32 | 32 | 32 | | | | | |
| 32 | 32 | 32 | | | | | |
| 32 | 32 | 32 | | | | | |
| 32 | 32 | 32 | 32 | | | | |
| 32 | 32 | 32 | 32 | | | | |
| 32 | 32 | 32 | 32 | | | | |
| 32 | 32 | 32 | 32 | 32 | | | |
| 32 | 32 | 32 | 32 | 32 | | | |
| 32 | 32 | 32 | 32 | 32 | | | |
| 32 | 32 | 32 | 32 | 32 | 32 | | |
| 32 | 32 | 32 | 32 | 32 | 32 | | |
| 32 | 32 | 32 | 32 | 32 | 32 | | |
| 32 | 32 | 32 | 32 | 32 | 32 | 32 | |
| 32 | 32 | 32 | 32 | 32 | 32 | 32 | |
| 32 | 32 | 32 | 32 | 32 | 32 | 32 | |
| 32 | 32 | 32 | 32 | 32 | 32 | 32 | 32 |
| 32 | 32 | 32 | 32 | 32 | 32 | 32 | 32 |
| 32 | 32 | 32 | 32 | 32 | 32 | 32 | 32 |
| | 32 | 32 | 32 | 32 | 32 | 32 | 32 |
| | 32 | 32 | 32 | 32 | 32 | 32 | 32 |
| | 32 | 32 | 32 | 32 | 32 | 32 | 32 |
| | | 32 | 32 | 32 | 32 | 32 | 32 |
| | | 32 | 32 | 32 | 32 | 32 | 32 |
| | | 32 | 32 | 32 | 32 | 32 | 32 |
| | | | 32 | 32 | 32 | 32 | 32 |
| | | | 32 | 32 | 32 | 32 | 32 |
| | | | 32 | 32 | 32 | 32 | 32 |
| | | | | 32 | 32 | 32 | 32 |
| | | | | 32 | 32 | 32 | 32 |
| | | | | 32 | 32 | 32 | 32 |
| | | | | | 32 | 32 | 32 |
| | | | | | 32 | 32 | 32 |
| | | | | | 32 | 32 | 32 |
| | | | | | | 32 | 32 |
| | | | | | | 32 | 32 |
| | | | | | | 32 | 32 |
| | | | | | | | 32 |
| | | | | | | | 32 |
| | | | | | | | 32 |

FIG. 15C

256nozzle 4pass

| (1) | (2) | (3) | (4) |
|---|---|---|---|
| 32 | | | |
| 32 | | | |
| 32 | 32 | | |
| 32 | 32 | | |
| 32 | 32 | 32 | |
| 32 | 32 | 32 | |
| 32 | 32 | 32 | 32 |
| 32 | 32 | 32 | 32 |
| 32 | 32 | 32 | 32 |
| 32 | 32 | 32 | 32 |
| 32 | 32 | 32 | 32 |
| 32 | 32 | 32 | 32 |
| 32 | 32 | 32 | 32 |
| 32 | 32 | 32 | 32 |
| 32 | 32 | 32 | 32 |
| 32 | 32 | 32 | 32 |
| 32 | 32 | 32 | 32 |
| 32 | 32 | 32 | 32 |
| 32 | 32 | 32 | 32 |
| 32 | 32 | 32 | 32 |
| 32 | 32 | 32 | 32 |
| 32 | 32 | 32 | 32 |
| 32 | 32 | 32 | 32 |
| 32 | 32 | 32 | 32 |
| 32 | 32 | 32 | 32 |
| 32 | 32 | 32 | 32 |
| | 32 | 32 | 32 |
| | 32 | 32 | 32 |
| | | 32 | 32 |
| | | 32 | 32 |
| | | | 32 |
| | | | 32 |

FIG. 15D

256nozzle 8pass

| (1) | (2) | (3) | (4) | (5) | (6) | (7) | (8) |
|---|---|---|---|---|---|---|---|
| 32 | | | | | | | |
| 32 | 32 | | | | | | |
| 32 | 32 | 32 | | | | | |
| 32 | 32 | 32 | 32 | | | | |
| 32 | 32 | 32 | 32 | 32 | | | |
| 32 | 32 | 32 | 32 | 32 | 32 | | |
| 32 | 32 | 32 | 32 | 32 | 32 | 32 | |
| 32 | 32 | 32 | 32 | 32 | 32 | 32 | 32 

FIG. 18

| PRINTING MEDIUM | CONVEYANCE PATH | MEDIUM SIZE | GRAYSCALE | PRINTING QUALITY | PER 32-NOZZLE FEED (115,200-dpi CORRECTION VALUE) | | | PER SCAN (115,200-DPI CORRECTION VALUE) | | |
|---|---|---|---|---|---|---|---|---|---|---|
| | | | | | α_before | α_shift | α_after | β_768 | β_shift | β_256 |
| GLOSSY MEDIUM 1 | ASF | A4 OR MORE | OFF | 1 | -2 | 0 | 1 | 6 | 20 | -6 |
| | | | | 3 | -2 | 0 | 1 | 18 | 30 | -6 |
| | | | ON | 1 | -2 | 0 | 1 | 3 | 0 | -6 |
| | | | | 3 | -2 | 0 | 1 | 3 | 0 | -6 |
| | | LESS THAN A4 | OFF | 1 | 0 | 0 | -4 | 6 | 20 | -6 |
| | | | | 3 | 0 | 0 | -4 | 18 | 30 | -6 |
| | | | ON | 1 | 0 | 0 | -4 | 3 | 0 | -6 |
| | | | | 3 | 0 | 0 | -4 | 3 | 0 | -6 |
| | U TURN | A4 OR MORE | OFF | 1 | -6 | 0 | 1 | 6 | 20 | -6 |
| | | | | 3 | -6 | 0 | 1 | 18 | 30 | -6 |
| | | | ON | 1 | -6 | 0 | 1 | 3 | 0 | -6 |
| | | | | 3 | -6 | 0 | 1 | 3 | 0 | -6 |
| | | LESS THAN A4 | OFF | 1 | -5 | 0 | -4 | 6 | 20 | -6 |
| | | | | 3 | -5 | 0 | -4 | 18 | 30 | -6 |
| | | | ON | 1 | -5 | 0 | -4 | 3 | 0 | -6 |
| | | | | 3 | -5 | 0 | -4 | 3 | 0 | -6 |
| GLOSSY MEDIUM 2 | ASF | A4 OR MORE | OFF | 1 | -1 | 0 | -5 | 18 | 0 | 0 |
| | | | | 3 | -1 | 0 | -5 | 30 | 20 | 6 |
| | | | | 4 | -1 | 0 | -5 | 30 | 0 | 0 |
| | | | ON | 1 | -1 | 0 | -5 | 9 | 0 | 2 |
| | | | | 3 | -1 | 0 | -5 | 9 | 0 | 2 |
| | | | | 4 | -1 | 0 | -5 | 9 | 0 | 2 |
| | | LESS THAN A4 | OFF | -1 | 1 | 0 | 1 | 18 | 0 | 0 |
| | | | | 3 | 1 | 0 | 1 | 30 | 20 | 6 |
| | | | | 4 | 1 | 0 | 1 | 30 | 0 | 0 |
| | | | ON | 1 | 1 | 0 | 1 | 9 | 0 | 2 |
| | | | | 3 | 1 | 0 | 1 | 9 | 0 | 2 |
| | | | | 4 | 1 | 0 | 1 | 9 | 0 | 2 |
| | U TURN | A4 OR MORE | OFF | 1 | -4 | 0 | -5 | 18 | 0 | 0 |
| | | | | 3 | -4 | 0 | -5 | 30 | 20 | 6 |
| | | | | 4 | -4 | 0 | -5 | 30 | 0 | 0 |
| | | | ON | 1 | -4 | 0 | -5 | 9 | 0 | 2 |
| | | | | 3 | -4 | 0 | -5 | 9 | 0 | 2 |
| | | | | 4 | -4 | 0 | -5 | 9 | 0 | 2 |
| | | LESS THAN A4 | OFF | 1 | -3 | 0 | 1 | 18 | 0 | 0 |
| | | | | 3 | -3 | 0 | 1 | 30 | 20 | 6 |
| | | | | 4 | -3 | 0 | 1 | 30 | 0 | 0 |
| | | | ON | 1 | -3 | 0 | 1 | 9 | 0 | 2 |
| | | | | 3 | -3 | 0 | 1 | 9 | 0 | 2 |
| | | | | 4 | -3 | 0 | 1 | 9 | 0 | 2 |
| MATTE MEDIUM 1 | ASF | A4 OR MORE | OFF | 1 | -3 | 0 | -2 | 6 | 40 | -6 |
| | | | | 3 | -3 | 0 | -2 | 12 | 10 | -15 |
| | | | ON | 1 | -3 | 0 | -2 | 3 | 15 | -6 |
| | | | | 3 | -3 | 0 | -2 | 3 | 15 | -6 |
| | | LESS THAN A4 | OFF | 1 | -1 | 0 | -2 | 6 | 40 | -6 |
| | | | | 3 | -1 | 0 | -2 | 12 | 10 | -15 |
| | | | ON | 1 | -1 | 0 | -2 | 3 | 15 | -6 |
| | | | | 3 | -1 | 0 | -2 | 3 | 15 | -6 |
| | U TURN | A4 OR MORE | OFF | 1 | -5 | 0 | -2 | 6 | 40 | -6 |
| | | | | 3 | -5 | 0 | -2 | 12 | 10 | -15 |
| | | | ON | 1 | -5 | 0 | -2 | 3 | 15 | -6 |
| | | | | 3 | -5 | 0 | -2 | 3 | 15 | -6 |
| | | LESS THAN A4 | OFF | 1 | -5 | 0 | -2 | 6 | 40 | -6 |
| | | | | 3 | -5 | 0 | -2 | 12 | 10 | -15 |
| | | | ON | 1 | -5 | 0 | -2 | 3 | 15 | -6 |
| | | | | 3 | -5 | 0 | -2 | 3 | 15 | -6 |

PRINTING APPARATUS AND CONVEYANCE AMOUNT CORRECTION METHOD FOR THE SAME

FIELD OF THE INVENTION

The present invention relates to a printing apparatus and a conveyance amount correction method for the printing apparatus and, more particularly, to the correction of the conveyance amount of a printing medium in a printing apparatus which prints an image on the printing medium by alternatively printing an image on the printing medium and conveying the printing medium.

BACKGROUND OF THE INVENTION

As an information output apparatus in, for example, a wordprocessor, personal computer, or facsimile apparatus, a printer which prints desired information such as characters and images on a sheet-like printing medium such as a paper sheet and film is widely used.

As a printing system for a printer, various schemes have been known. In recent years, inkjet systems have received a great deal of attention because information can be printed on a printing medium such as a paper sheet in a non-contact manner, color information can be easily printed, and printing is very quiet. Of such inkjet systems, a serial printing arrangement of performing printing while reciprocally scanning a printhead, which discharges ink in accordance with desired printing information, in a direction crossing the conveyance direction of a printing medium such as a paper sheet has been widely used because of low cost, small size, and the like.

The basic operation of such an inkjet printing apparatus will be described below. First of all, printing media are fed one by one from a paper feed unit, on which printing media are stacked, by a feed roller. The fed printing medium is repeatedly conveyed by a predetermined amount by a roller pair comprising a conveyance roller and a pinch roller. With regard to the scanning direction, a carriage on which a printhead is mounted is moved (scanned) in a direction almost perpendicular to the above conveyance direction by a carriage motor to place the printhead at a target image formation position.

The positioned printhead discharges ink onto the printing medium in accordance with a signal from an electric board. Image formation on the printing medium is performed by alternately repeating main scanning operation and sub-scanning operation. In the main scanning operation, the carriage is scanned while printing is performed by the printhead. In the sub-scanning operation, the printing medium is conveyed by the conveyance roller.

It is however known that the conveyance amount of a printing medium by the conveyance roller sometimes differs from a target predetermined conveyance amount (set value) due to, for example, a change in the friction coefficient between the conveyance roller and the printing medium or the fictional force which the printing medium receives from the conveyance path.

FIGS. 11A to 11E are schematic views showing the pattern of printed dots formed on a printing medium when the conveyance amount of the printing medium by the conveyance roller coincides with a set value. FIGS. 11A to 11E show a case wherein printing in a predetermined area is completed by making a printhead having a predetermined number of nozzles repeat main scanning four times, that is, so-called 4-pass printing is performed.

Referring to FIGS. 11A to 11E, each circle "○" represents a printed dot, and the number inside the circle indicates that the dot was printed by scanning operation in a specific ordinal position. FIG. 11A shows the pattern of printed dots formed by the first main scanning operation. When the first main scanning operation is complete, sub-scanning is performed to convey the printing medium by a predetermined amount. FIG. 11B shows the pattern of printed dots formed by the second main scanning operation. Subsequently, main scanning and sub-scanning are repeated in the order shown in FIGS. 11C, 11D, and 11E to complete printing in an 8×8 dot area.

FIGS. 12A to 12E are views showing the pattern of printed dots formed on a printing medium in the same manner shown in FIGS. 11A to 11E when the conveyance amount of the printing medium by the conveyance roller becomes smaller than the set value. After the first scanning operation shown in FIG. 12A, printed dots are formed at the positions shown in FIG. 12B because the conveyance amount is slightly smaller than the set value. Subsequently, since the conveyance amount in each sub-scanning operation is smaller than the set value, printing of a dot pattern in an 8×8 dot area is finally complete as shown in FIG. 12E.

Since the conveyance amount in each sub-scanning operation is smaller than the set value, the dot pattern becomes relatively dense in the conveyance direction. As a consequence, a portion with a noticeable overlap of printed dots appears at the position indicated by the arrow in FIG. 12E. This overlap of dots becomes a black stripe which periodically appears on a completed image. This black stripe becomes more noticeable as the conveyance amount of the printing medium becomes smaller than the set value, resulting in a deterioration in image quality.

FIGS. 13A to 13E are views showing the pattern of printed dots formed on a printing medium in the same manner shown in FIGS. 11A to 11E when the conveyance amount of the printing medium by the conveyance roller becomes larger than the set value. After the first scanning operation shown in FIG. 13A, printed dots are formed at the positions shown in FIG. 13B because the conveyance amount is slightly larger than the set value. Subsequently, since the conveyance amount in each sub-scanning operation is larger than the set value, printing of a dot pattern in an 8×8 dot area is finally complete as shown in FIG. 13E.

Since the conveyance amount in each sub-scanning operation is larger than the set value, the dot pattern becomes relatively sparse in the conveyance direction. As a consequence, a noticeable non-dot portion appears at the position indicated by the arrow in FIG. 13E. This non-dot portion becomes a white stripe which periodically appears on a completed image. This white stripe becomes more noticeable as the conveyance amount of the printing medium becomes larger than the set value, resulting in a deterioration in image quality.

Japanese Patent Laid-Open Nos. 06-238969 and 07-314788 disclose a technique of correcting the conveyance amount of a printing medium in order to prevent a deterioration in printing image quality due to conveyance amount errors like those described above.

It has become clear that even if the conveyance amount of a printing medium in the above case is corrected, the following problem exists.

Even if a printing medium is conveyed by a conveyance amount made to coincide with a set value by correction, stripes may occur on a printed image. FIG. 14 is a schematic view showing the trajectories of ink droplets discharged from a printhead by using arrows. As shown in FIG. 14, the ink droplets discharged from the respective nozzles of the printhead are influenced until landing on the printing medium by the airflow produced when the printhead moves in the main scanning direction or the airflow produced when ink droplets move in mass in the air.

For this reason, the ink discharged from the end portions of the nozzle array is deflected in a direction toward the middle of the nozzle array. As a consequence, when printing is performed with the conveyance amount set on the assumption that ink droplets discharged from the printhead are landed immediately below the nozzles, white stripes occur on the image. Note that the influence of such an airflow varies depending on the number of nozzles used for printing and the number of print passes. The reason why the influence varies depending on the number of print passes is that the density of ink discharged in one main scanning operation varies depending on the number of print passes.

When printing is to be performed while the conveyance amount is changed in accordance with the position of a printing medium, correction can be performed in accordance with the friction coefficient between the conveyance roller and the printing medium and the frictional force which the printing medium receives from the convey path by setting correction amounts corresponding to the respective different conveyance amounts to the values obtained by multiplying the respective conveyance amounts by predetermined coefficients.

When, however, the respective conveyance amounts are to be corrected considering the influence of the above airflow as well, it is not sufficient to only multiply the respective conveyance amounts by the predetermined coefficients. That is, the image quality of a printed image deteriorates.

SUMMARY OF THE INVENTION

It is an object of the present invention to correct a conveyance amount in accordance with not only a mechanical factor such as a change in frictional force but also the deviation of a printing position due to another factor.

In order to achieve the above object, according to an aspect of the present invention, there is provided a printing apparatus comprising: printing means for printing an image on a printing medium, and conveyance means for moving the printing medium relative to the printing means, the printing apparatus printing an image on the printing medium by alternately performing printing of an image by the printing means and conveyance of the printing medium by the conveyance means, wherein the printing apparatus further comprises correcting means for correcting a conveyance amount by the conveyance means by using a first parameter and second parameter for correcting the conveyance amount by the conveyance means in accordance with different factors.

In order to achieve the above object, according to another aspect of the present invention, there is provided a conveyance amount correction method for a printing apparatus comprising: a printing step of causing printing means to print an image on the printing medium, and a conveyance step of moving the printing medium relative to the printing means, the printing step and the conveyance step being alternatively performed for printing an image on a printing medium, wherein the method further comprises a correction step of correcting a conveyance amount in the conveyance step by using a first parameter and second parameter for correcting the conveyance amount in the conveyance step in accordance with different factors.

According to the present invention, in a printing apparatus which prints an image on a printing medium by alternately performing printing of an image on the printing medium by using a printing means and conveyance of the printing medium relative to the printing means, the conveyance amount in conveyance is corrected by using the first and second parameters for correcting the conveyance amount in accordance with different factors.

With this operation, the conveyance amount can be corrected in accordance with not only a mechanical factor such as a change in frictional force but also the deviation of the printing position due to another factor by, for example, making the first parameter correspond to a change in mechanical frictional force in conveyance of the printing medium and making the second parameter correspond to a setting associated with printing quality.

Although a correction amount for the deviation of a conveyance amount due to mechanical frictional force varies in accordance with the conveyance amount, the first parameter for this correction can be calculated from the conveyance amount by setting the first parameter as a conveyance correction amount corresponding to the unit of conveyance amount before correction without having any correction values corresponding to all feasible conveyance amounts in the form of a table. Since proper correction amounts for the respective conveyance amounts can be obtained, the storage area for parameters can be saved and the correction algorithm can be simplified.

Therefore, a high-quality image can be formed by preventing the occurrence of white and black stripes which are produced because actual conveyance amounts differ from set values.

The a first parameter may be defined as a conveyance correction amount corresponding to a unit of conveyance amount before correction, and the second parameter may be defined as a conveyance correction amount to be added per conveyance cycle corrected by the first parameter.

Alternatively, the first parameter may be a parameter corresponding to a positional relationship between the printing medium and the conveyance means.

The conveyance means may include two rollers on two sides of an area in which printing is performed by the printing means, and a value of the first parameter varies depending on by which roller conveyance of the printing medium is controlled.

In this case, the value of the first parameter may vary in accordance with three states including a state in which the printing medium is conveyed by a roller on an upstream side, a state in which a trailing edge of the printing medium separates from the roller on the upstream side, and a state in which the printing medium is conveyed by only a roller on a downstream side.

The value of the first parameter may change in accordance with a type of printing medium, or in accordance with a size of a printing medium.

The conveyance means may include two conveyance paths, and the value of the first parameter may change in accordance with the conveyance path used.

The second parameter may be a parameter corresponding to a setting associated with printing quality.

In this case, the printing means may perform printing by causing a printhead having a plurality of printing elements arrayed in a predetermined direction to scan in a direction crossing a conveyance direction of the printing medium, and a value of the second parameter may vary in accordance with the number of times of scanning required to complete printing in each area.

The apparatus may further comprise a table which stores values of the first parameter and second parameter in accordance with factors.

In addition, the above object can also be achieved by a computer program which causes a computer to execute a conveyance amount correction method for the above printing apparatus, and a storage medium storing the computer program.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIGS. 12A to 12E are views showing an example of the pattern of printed dots formed when 4-pass printing is performed;

FIGS. 13A to 13E are views showing an example of the pattern of printed dots formed when 4-pass printing is performed;

FIGS. 15A to 15F are views for explaining how conveyance of a printing medium and printing thereon are performed in the embodiment;

FIG. 18 is a table showing examples of conveyance amount correction parameters in this embodiment.

DETAILED DESCRIPTION OF THE PREFERRED EMBODIMENTS

Preferred embodiments of the present invention will now be described in detail in accordance with the accompanying drawings. Note that each elements in the following embodiments is not intended to limit the scope of the invention, but is described only as an example.

In this specification, "print" means not only to form significant information such as characters and graphics, but also to form, e.g., images, figures, and patterns on printing media in a broad sense, regardless of whether the information formed is significant or insignificant or whether the information formed is visualized so that a human can visually perceive it, or to process printing media.

"Print media" are any media capable of receiving ink, such as cloth, plastic films, metal plates, glass, ceramics, wood, and leather, as well as paper sheets used in common printing apparatuses.

Further, "ink" (to be also referred to as a "liquid" hereinafter) should be broadly interpreted like the definition of "print" described above. That is, ink is a liquid which is applied onto a printing medium and thereby can be used to form images, figures, and patterns, to process the printing medium, or to process ink (e.g., to solidify or insolubilize a colorant in ink applied to a printing medium).

Moreover, "nozzle" should be interpreted as any combination of a discharge opening, a channel communicating thereto and an energy-generating element used for discharging ink, without annotation.

A printing apparatus using a printhead based on the inkjet scheme will be exemplified as an embodiment of the printing apparatus according to the present invention.

(Arrangement of Mechanical Portion)

The arrangement of a mechanical portion of an embodiment of the printing apparatus according to the present invention will be described first. The printing apparatus body according to this embodiment can be classified into a paper feed unit, paper sheet conveyance unit, paper discharge unit, carriage unit, cleaning unit, and exterior unit according to the functions of the respective mechanisms. These units will be described below in outline item by item.

(A) Paper Feed Unit

Figure 1:
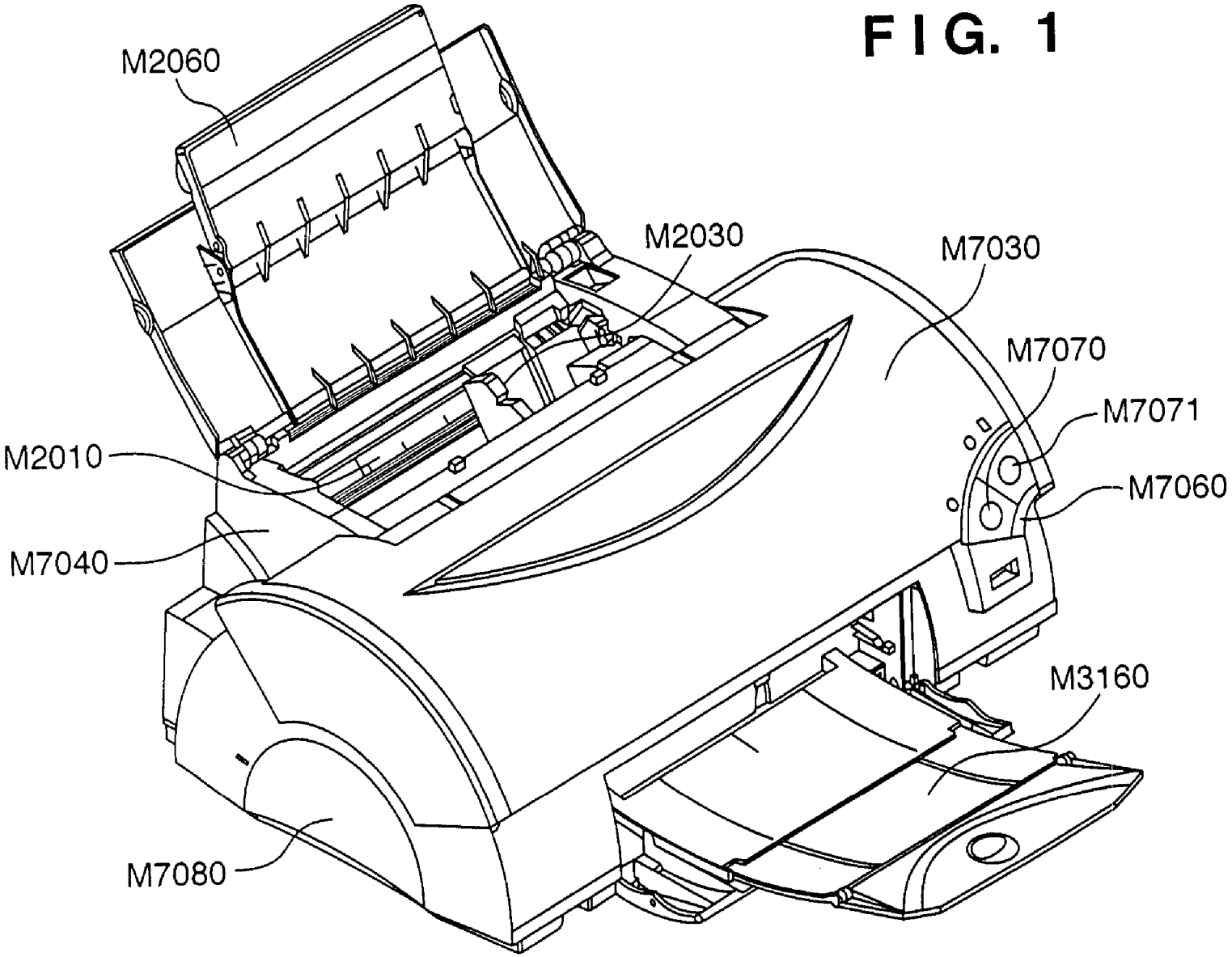
FIG. 1 is a perspective view showing the overall arrangement of a printing apparatus according to an embodiment of the present invention.
Figure 2:
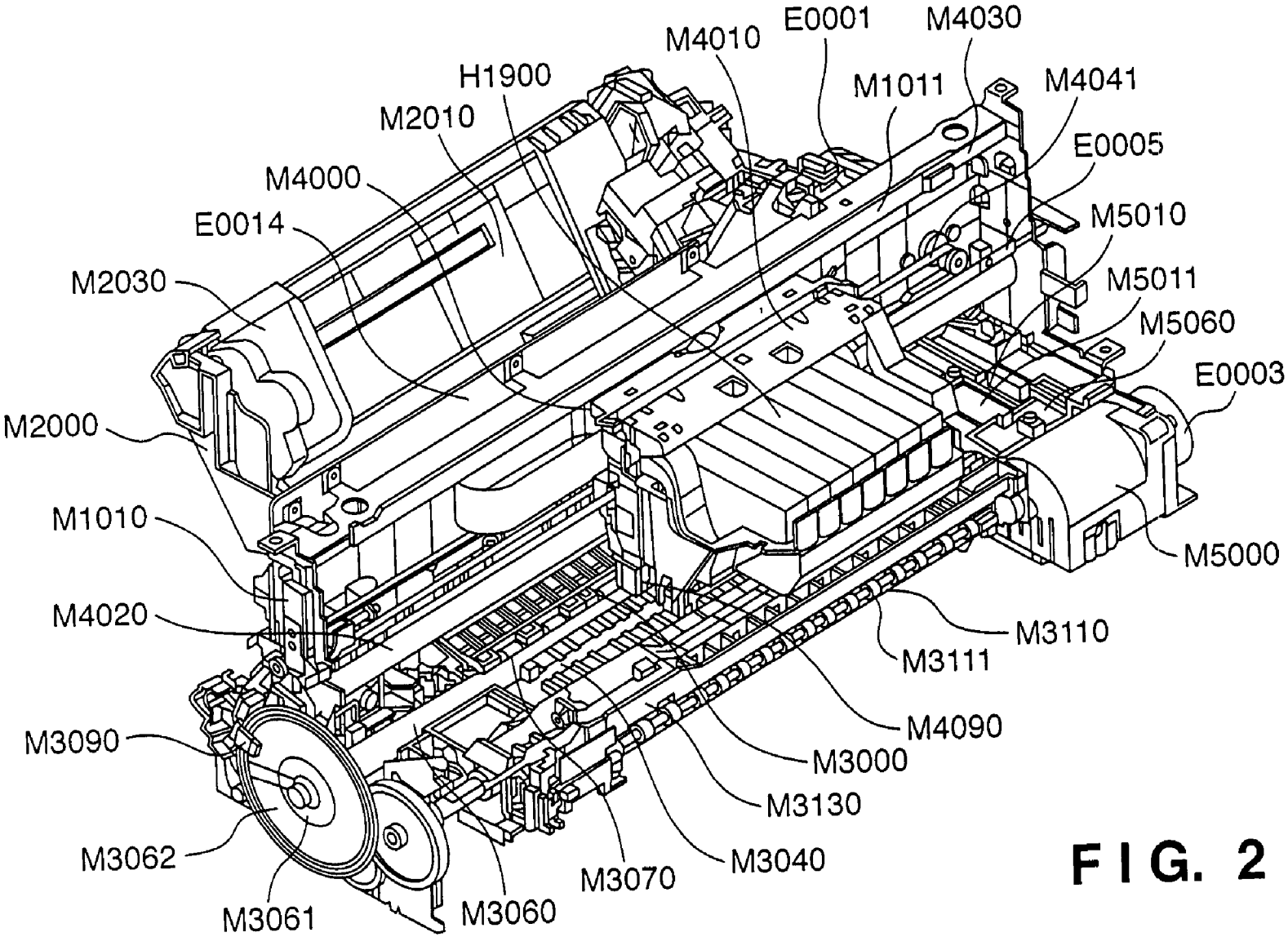
FIG. 2 is a perspective view showing the mechanical unit of the printing apparatus in FIG. 1.
Figure 3:
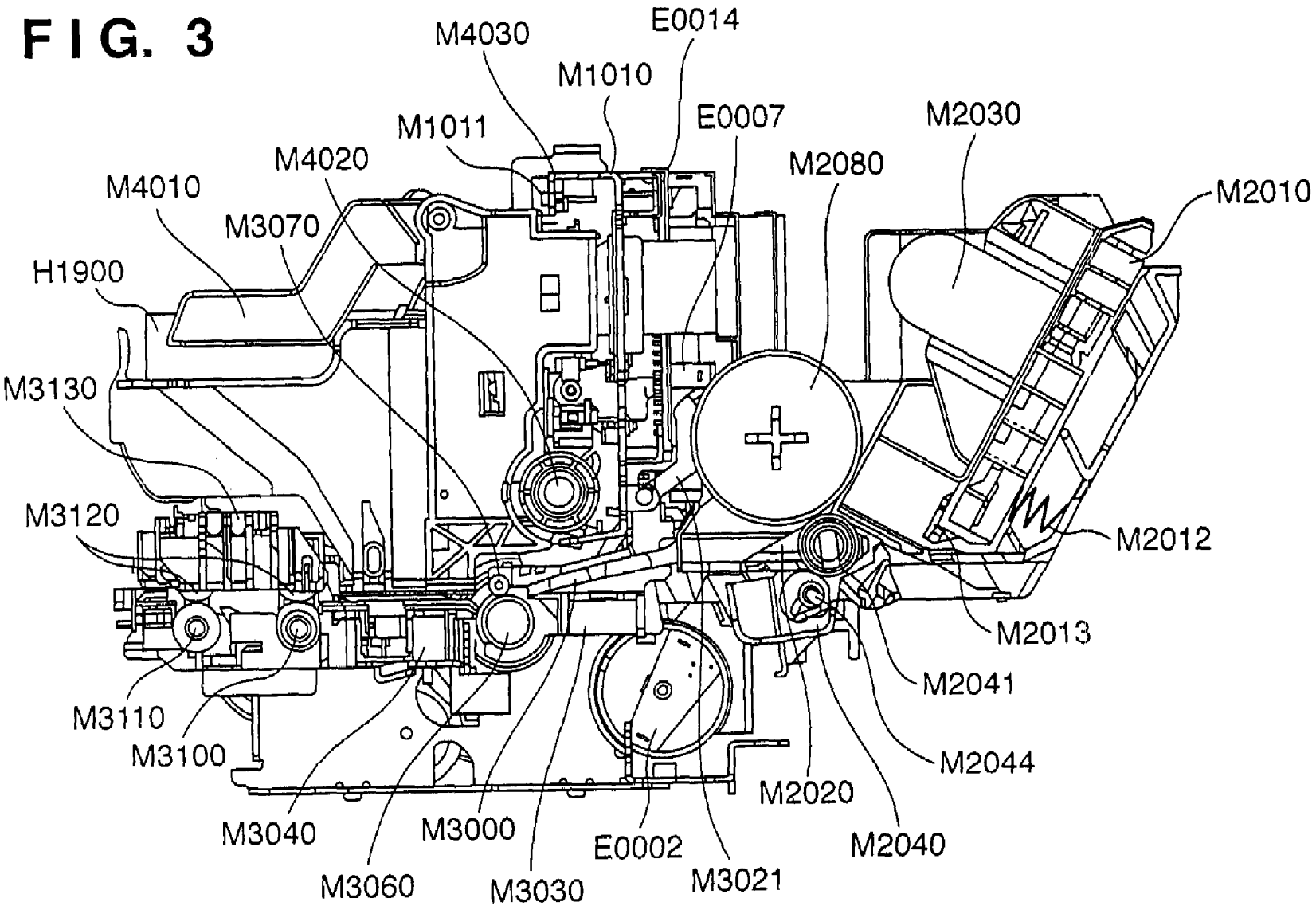
FIG. 3 is a sectional view of the printing apparatus in FIG. 1.

FIG. 1 is a perspective view of a printing apparatus according to this embodiment. FIGS. 2 and 3 are views for explaining the internal mechanism of the printing apparatus body. FIG. 2 is a perspective view of the internal mechanism viewed from the upper left portion. FIG. 3 is a cross-sectional view of the printing apparatus body.

Paper Feed Unit 1 (Auto Sheet Feeder)

Referring to FIGS. 1 to 3, the paper feed unit is configured such that a pressure plate M2010 on which printing media are stacked, a feed roller M2080 which feeds printing media one by one, a separation roller M2041 which separates printing media, a return lever M2020 for returning the printing medium to the stacking position, and the like are mounted on a base M2000.

A paper feed tray M2060 for holding the stacked printing media is mounted on the base M2000 or its exterior. The paper feed tray M2060 is of a multistage type, and is rotated in use.

In a normal standby state, the pressure plate M2010 is released by a pressure plate cam M2014, and the separation roller M2041 is released by a control cam M2050. The return lever M2020 is provided at a stacking position where it returns a printing medium and blocks the stacking port so as to prevent the stacked printing media from entering the deep part.

When paper feed is to be performed, the separation roller M2041 is brought into contact with the feed roller M2080 by motor driving. When the return lever M2020 is released, the pressure plate M2010 comes into contact with the feed roller M2080. In this state, feeding of a printing medium is started. The printing medium is restrained by a pre-stage separation unit M2001 (not shown) provided on the base M2000, and only a predetermined number of printing media are fed to the nip portion comprised of the feed roller M2080 and separation roller M2041. The fed printing media are separated by the nip portion, and only the uppermost printing medium is conveyed to the paper sheet conveyance unit.

When the printing medium reaches a conveyance roller M3060 and pinch roller M3070, the pressure plate M2010 and separation roller M2041 are released by a pressure plate cam (not shown) and control cam, respectively. The return lever M2020 is returned to the stacking position by the control cam. With this operation, the printing medium which has reached the nip portion comprised of the feed roller M2080 and separation roller M2041 is returned to the stacking position.

Paper Feed Unit 2 (U Turn Cassette Feeder)

Figure 4:
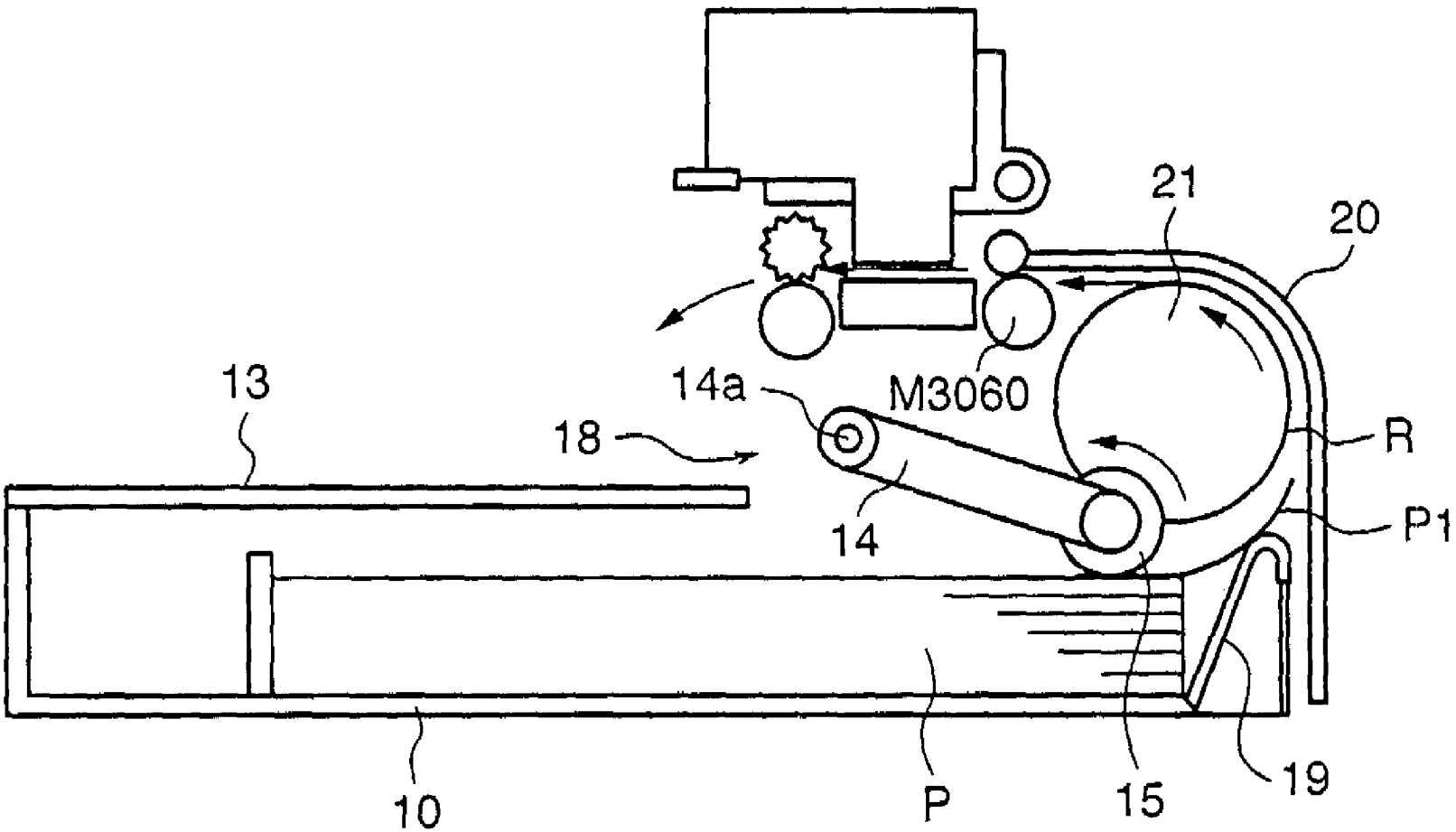
FIG. 4 is a schematic view showing a state wherein a paper feed unit is mounted in the lower portion of the printing apparatus according to the embodiment.
Figure 5:
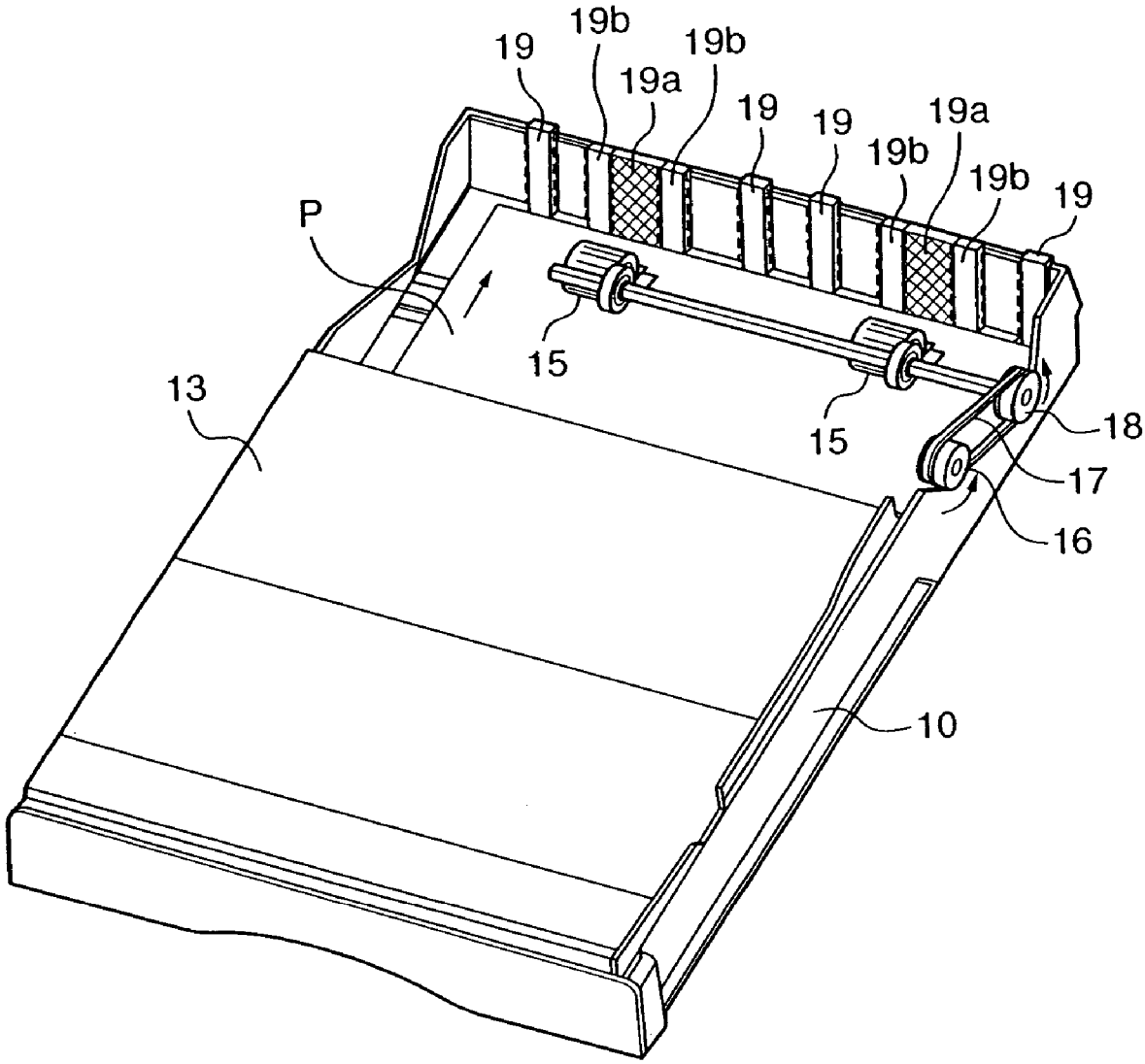
FIG. 5 is a perspective view showing the arrangement of the paper feed unit in FIG. 4.

FIGS. 4 and 5 show a paper feeder 13 which can be mounted as the second paper feed unit on the printing apparatus according to this embodiment. FIG. 4 is a schematic view showing a state wherein the paper feeder 13 is mounted on the lower portion of the printing apparatus. FIG. 5 is a perspective view showing the arrangement of the paper feeder 13.

As shown in FIG. 4, the paper feeder 13 comprises a paper feed cassette 10 serving as a printing medium storing means which is detachably mounted on the printing apparatus body and a feed roller 15 serving as a printing medium feeding means for feeding a printing medium P stored in the paper feed cassette 10.

The paper feed cassette 10 has, on an end portion on the upstream side in the printing medium feeding direction, a separation plate 19 serving as an inclined surface member which comes into contact with a printing medium P fed by the rotation of the feed roller 15 and separates printing media P one by one. Note that the printing medium P is stored in the paper feed cassette 10 with the image printing surface side facing down.

The feed roller 15 is provided above the paper feed cassette 10 and is held on an arm 14 which is swingably supported on a fulcrum 14*a* located on the upstream side of the feed roller 15. The feed roller 15 can freely rotate and come into contact with and move away from the printing medium P stored in the paper feed cassette 10. As shown in FIG. 4, the conveyance roller M3060, a U-turn roller 21, and a roller guide 20 provided at a position to face the U-turn roller 21 are provided near the paper feed cassette 10.

In printing operation, the feed roller 15 is brought into contact with the uppermost printing medium P of the printing media P stacked on the paper feed cassette 10 by the weight of the roller and downward swinging of the arm 14, and is rotated by driving force from a drive source (not shown) which is transmitted through a pulley 16, belt 17, and gear 18. A printing medium P1 fed by the rotation of the feed roller 15 travels toward the conveyance roller M3060 through a sheet conveyance path R formed between the U-turn roller 21 and the roller guide 20.

(B) Paper Sheet Conveyance Unit

The printing medium fed to the paper sheet conveyance unit is guided by a pinch roller holder M3000 and paper guide flapper M3030 and is fed to the roller pair of the conveyance roller M3060 and the pinch roller M3070. At this time, a PE sensor lever M3021 detects the leading edge of a printing medium to obtain a printing position for the printing medium.

The roller pair of the conveyance roller M3060 and the pinch roller M3070 is rotated by driving an LF motor E0002. The printing medium is conveyed to a platen M3040 by this rotation. A rib serving as a conveyance reference surface is formed on the platen M3040. With this rib, the gap between a printhead H1001 and the printing medium surface is managed. At the same time, the rib also has a function of suppressing the undulations of the printing medium in cooperation with a paper discharge unit (to be described later).

(C) Paper Discharge Unit

A printing medium on which an image is printed is clamped by the nip between a first paper discharge roller M3110 and a spur M3120 and conveyed to be discharged onto a paper discharge tray M3160. The paper discharge tray M3160 is divided into a plurality, of portions and can be housed below a lower case M7080 (to be described later). The tray M3160 is pulled out in use.

(D) Carriage Unit

The carriage unit includes a carriage M4000 on which the printhead H1001 is to be mounted. The carriage M4000 is supported by a guide shaft M4020 and guide rail M1011. The guide shaft M4020 is mounted on a chassis M1010 and guides/supports the carriage M4000 to reciprocally scan it in a direction perpendicular to the conveyance direction of the printing medium.

The carriage M4000 is driven by a carriage motor E0001, which is mounted on the chassis M1010, through a timing belt M4041. A flexible cable E0012 (to be described in detail later with reference to FIG. 6) for transferring a driving signal from an electric board E0014 to the printhead H1001, is connected to the carriage M4000.

When an image is to be formed on a printing medium in the above arrangement, the roller pair constituted by the conveyance roller M3060 and pinch roller M3070 conveys the printing medium so as to position it in the conveyance direction. In the scanning direction, the printhead H1001 is placed at a target image formation position by causing the carriage motor E0001 to move the carriage M4000 in a direction almost perpendicular to the above conveyance direction on the basis of the information obtained by reading the pattern of an encoder scale E0005 attached along the guide shaft M4020 by using an encoder sensor mounted on a carriage board (to be described later). The positioned printhead H1001 discharges ink onto a printing medium in accordance with a signal from the electric board E0014.

The detailed arrangement of the printhead H1001 and the printing system will be described below. The printing apparatus of this embodiment is configured to form an image on a printing medium by alternately repeating main scanning operation of scanning the carriage M4000 while performing printing by using the printhead H1001 and sub-scanning operation of conveying the printing medium using the conveyance roller M3060.

(E) Cleaning Unit

The cleaning unit comprises a pump M5000 for cleaning the printhead H1001, a cap M5010 for suppressing drying of the printhead H1001, a blade (not shown) for cleaning the orifice formation surface of the printhead H1001, and the like.

(F) Exterior Unit

The units (A) to (E) described above are mainly built into the chassis M1010 and form the mechanical portion of the printing apparatus. The exterior is mounted on the printing apparatus so as to cover it. The exterior unit is mainly comprised of a lower case M7080, upper case M7040, and access cover M7030. In addition, the upper case is provided with an LED guide M7060 which transmits/displays light from an LED, key switches M7070 and M7071 which act on switches on the board, and the like.

(Electrical Circuit Arrangement)

The arrangement of an electrical circuit in the printing apparatus according to this embodiment will be described next.

Figure 6:
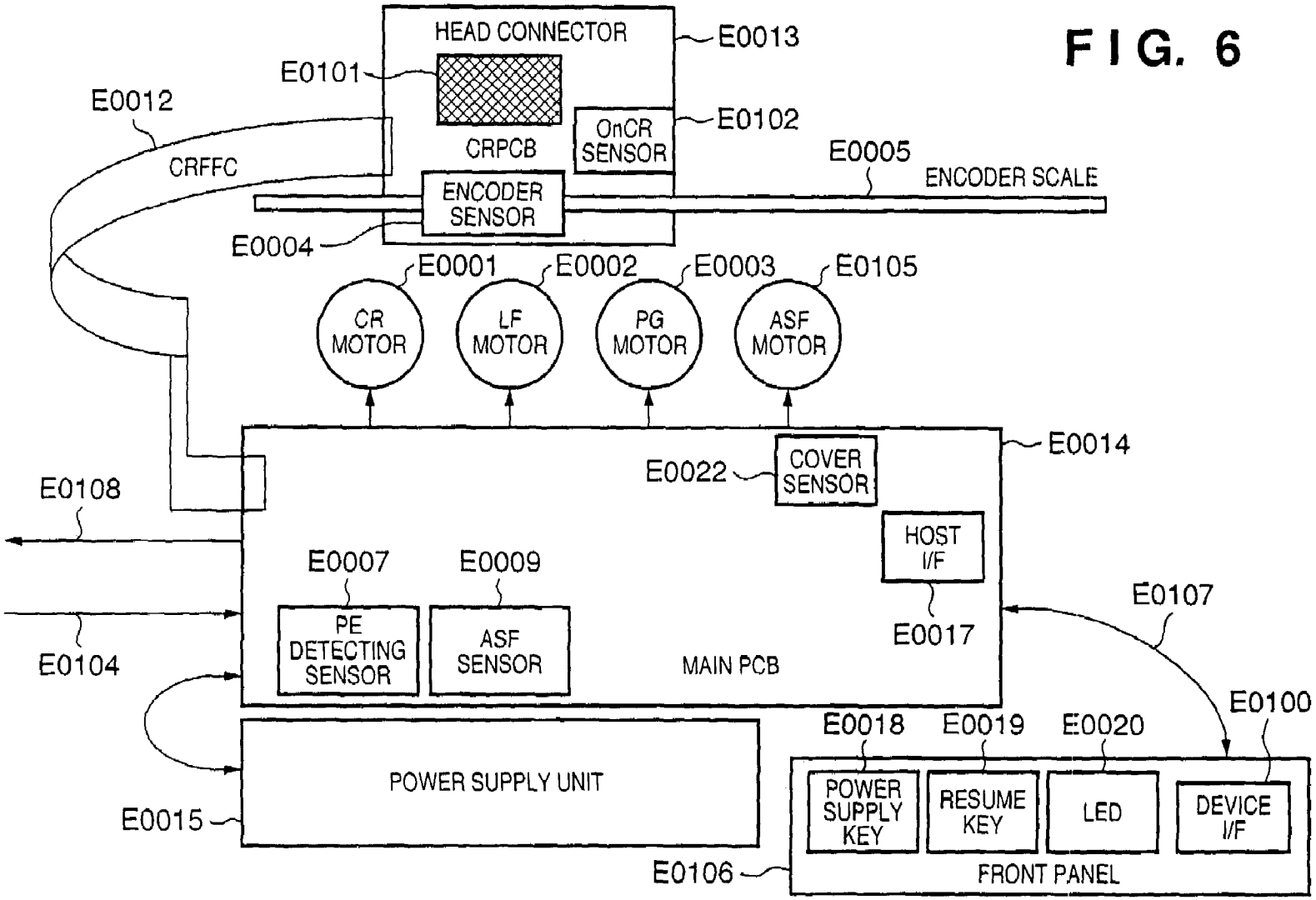
FIG. 6 is a block diagram schematically showing the overall arrangement of an electrical circuit in the embodiment.

FIG. 6 is a block diagram for briefly explaining the overall arrangement of the electrical circuit in this embodiment of the present invention.

The printing apparatus of this embodiment is mainly comprised of a carriage board (CRPCB) E0013, the main PCB (Printed Circuit Board) E0014, a power supply unit E0015, a front panel E0106, and the like.

The carriage board (CRPCB) E0013 is a printed circuit board unit mounted on the carriage M4000, and functions as an interface which exchanges signals with the printhead H1001 through a head connector E0101. The carriage board E0013 is provided with an encoder sensor E0004 which reads the pattern of the encoder scale E0005, a temperature sensor such as a thermistor for detecting an ambient temperature, and a necessary optical sensor (these sensors will be referred to as an OnCR sensor E0102 hereafter). The information obtained by the OnCR sensor E0102 is output to the main PCB E0014 through the flexible flat cable (CRFFC) E0012, together with the information output from the encoder sensor E0004 and the head temperature information output from a printhead cartridge H1000 through the head connector E0101.

The main PCB E0014 is a printed circuit board unit which performs driving control of the respective units of the inkjet printing apparatus according to this embodiment. A paper end detecting sensor (PE sensor) E0007, automatic sheet feeder (ASF) sensor E0009, cover sensor E0022, and host interface (host I/F) E0017 are mounted on this board. The main PCB E0014 controls driving of the respective functions by being connected to the respective types of motors such as the carriage motor E0001 serving as a drive source for main-scanning the carriage M4000, the LF motor E0002 serving as a drive source for conveying a printing medium, a PG motor E0003 serving as a drive source for recovery operation of the printhead H1001, and an ASF motor E0105 serving as a drive source for paper feed operation for a printing medium. The front panel E0106 is a unit provided on the front surface of the printing apparatus body so as to provide convenience for user operation, and has a resume key E0019, an LED E0020, a power supply key E0018, and a device I/F E0100 used for connection to peripheral devices such as a digital camera.

Figure 7:
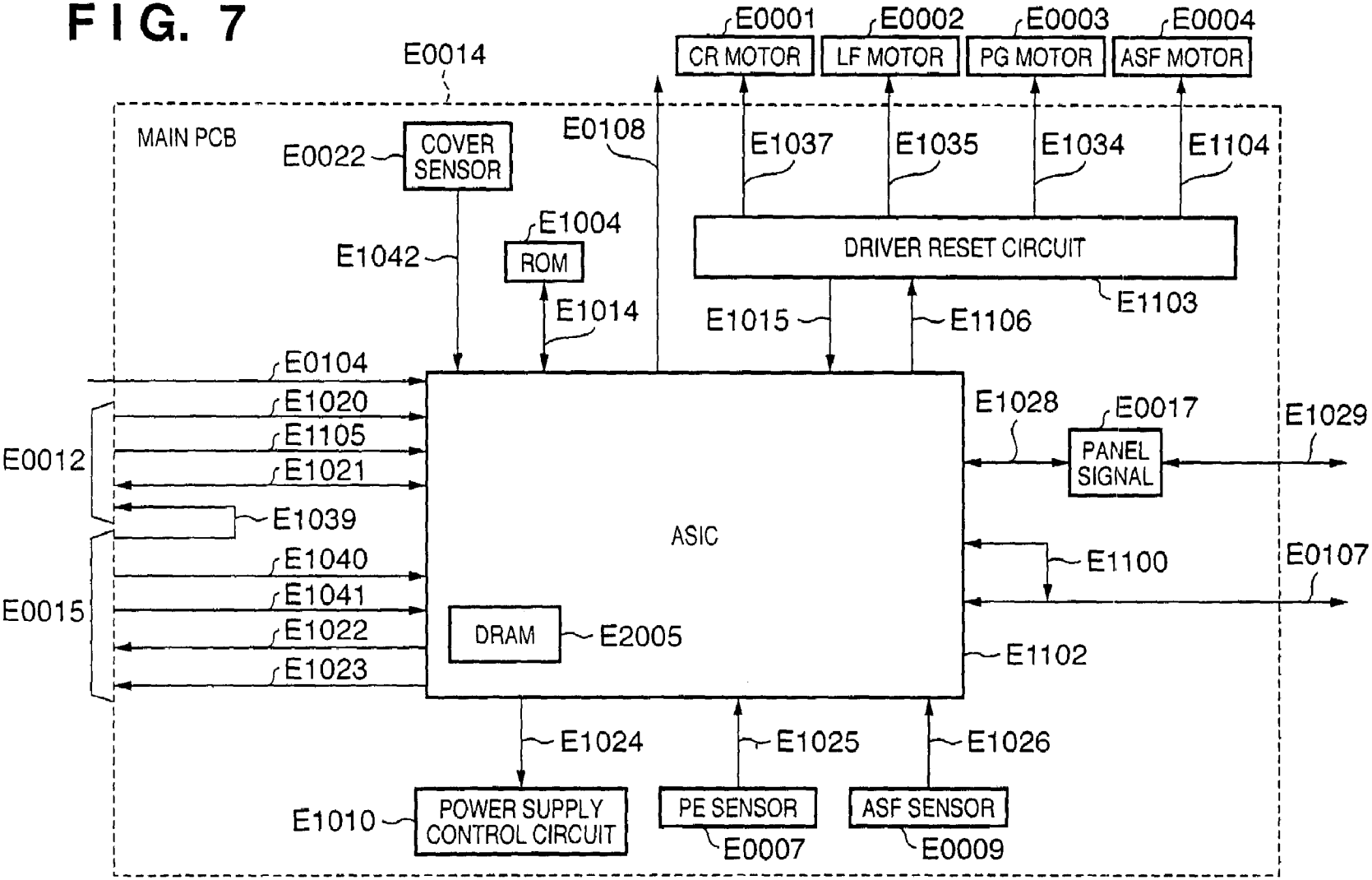
FIG. 7 is a block diagram showing an example of the internal arrangement of a main PCB in FIG. 6.

FIG. 7 is a block diagram showing the internal arrangement of a main PCB E1004.

Referring to FIG. 7, reference symbol E1102 denotes an ASIC (Application Specific Integrated Circuit), which is connected to a ROM E1004 through a control bus E1014 to perform various types of control in accordance with programs stored in the ROM E1004.

The ASIC E1102 is a semiconductor integrated circuit incorporating a 1-chip processor, and exchanges signals with the host I/F E0017. In addition, the ASIC E1102 exchanges signals with the device I/F E0100 on the front panel through a panel signal E0107. The ASIC E1102 controls printing operation by supplying a head control signal E1021 to the printhead H1001 through the flexible flat cable E0012, carriage board E0013, and head connector E0101.

The ASIC E1102 further includes a DRAM E2005. The DRAM E2005 serves as a data buffer for printing and has areas necessary for operation, e.g., a reception buffer E2010, work buffer E2011, print buffer E2014, and bitmap data buffer E2016.

(Arrangement of Printhead)

The arrangement of the printhead cartridge H1000 used in the printing apparatus according to this embodiment will be described below.

The printhead cartridge H1000 in this embodiment includes the printhead H1001, a means for mounting ink tanks H1900, and a means for supplying ink from the ink tanks H1900 to the printhead, and is detachably mounted on the carriage M4000.

Figure 8:
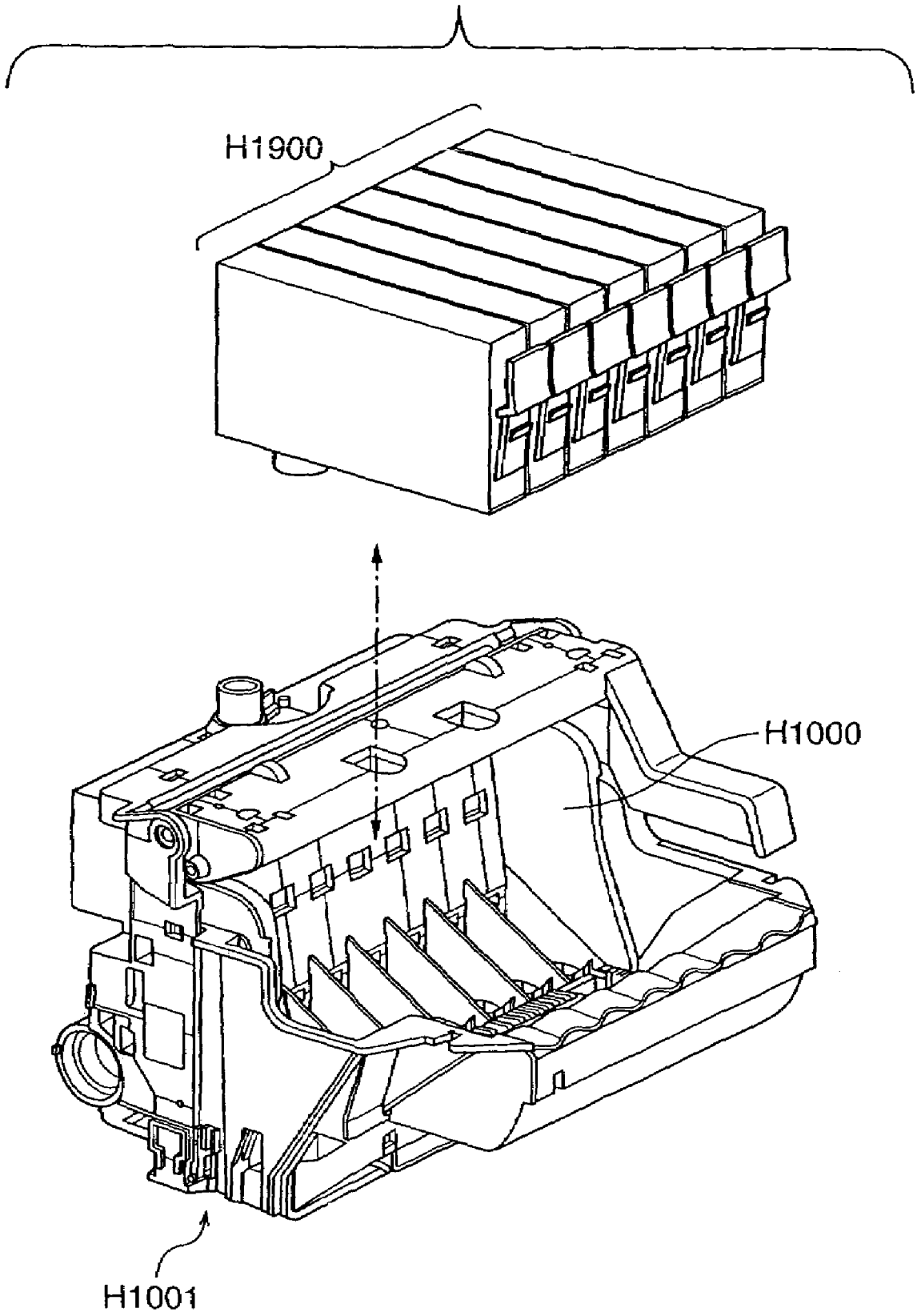
FIG. 8 is a perspective view showing a state wherein ink tanks are mounted in a head cartridge used in the embodiment.

FIG. 8 is a view showing how the ink tanks H1900 are mounted on the printhead cartridge H1000 used in this embodiment. The printing apparatus of this embodiment forms an image by using inks of seven colors, i.e., cyan, magenta, yellow, black, red, green, and blue inks, and hence the ink tanks H1900 are independently prepared for the seven colors. As shown in FIG. 8, each ink tank can be detachably mounted on the printhead cartridge H1000. Note that the ink tank H1900 can be attached and detached while the printhead cartridge H1000 is mounted on the carriage M4000.

Figure 9:
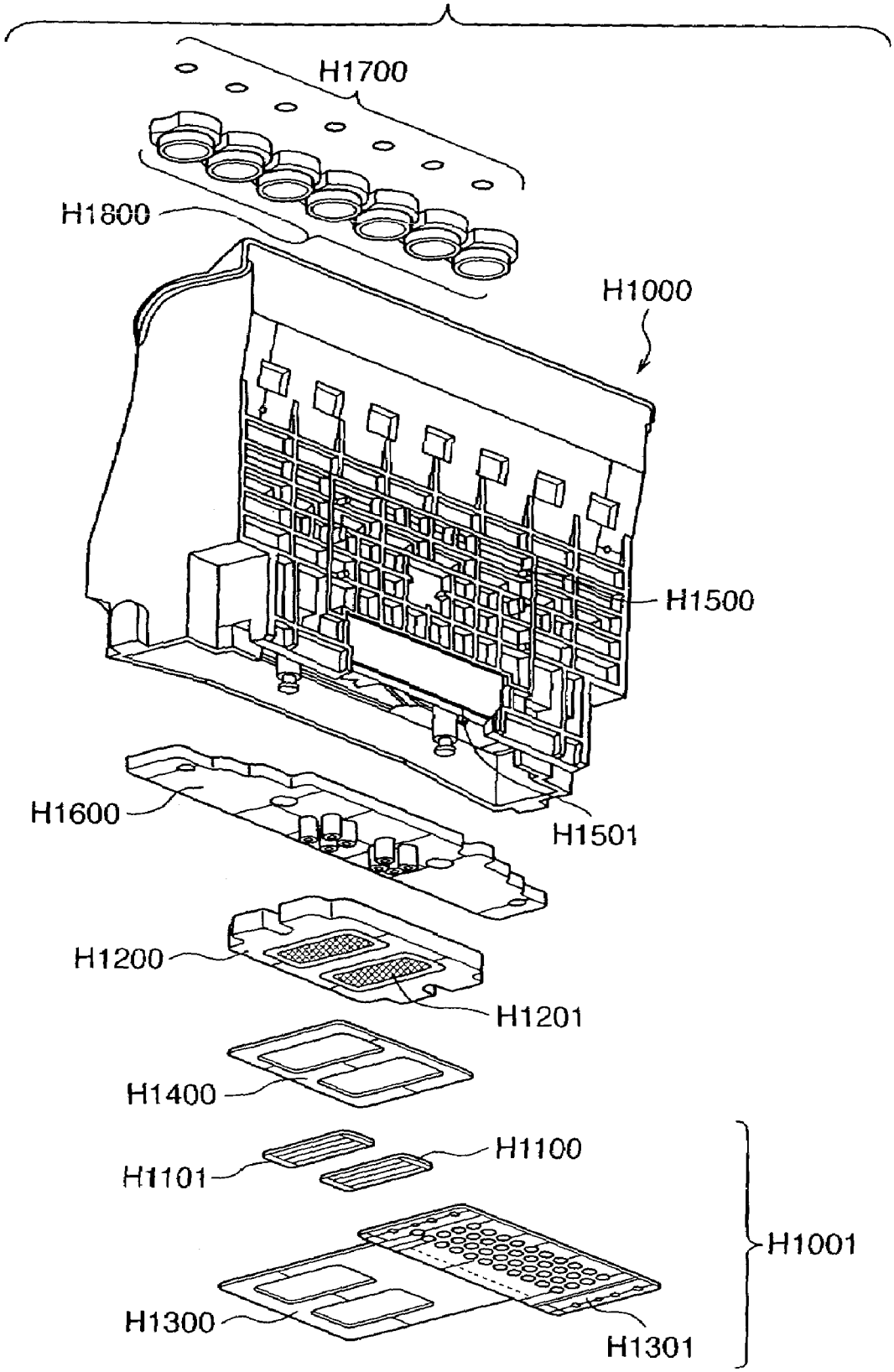
FIG. 9 is an exploded perspective view of the head cartridge used in the embodiment.

FIG. 9 is an exploded perspective view of the printhead cartridge H1000. Referring to FIG. 9, the printhead cartridge H1000 comprises a first printing element board H1100, second printing element board H1101, first plate H1200, second plate H1400, electric wiring board H1300, tank holder H1500, channel forming member H1600, filter H1700, seal rubber H1800, and the like.

The first printing element board H1100 and second printing element board H1101 are Si boards. A plurality of printing elements (nozzles) for discharging ink are formed on one surface of each of these boards by photolithography. Electric wirings such as Al wirings for supplying power to the respective printing elements are formed by a film forming technique, and a plurality of ink channels corresponding to the respective printing elements are also formed by photolithography. In addition, ink supply ports for supplying ink to the ink channels are formed in the back surface of each of the Si boards.

Figure 10:
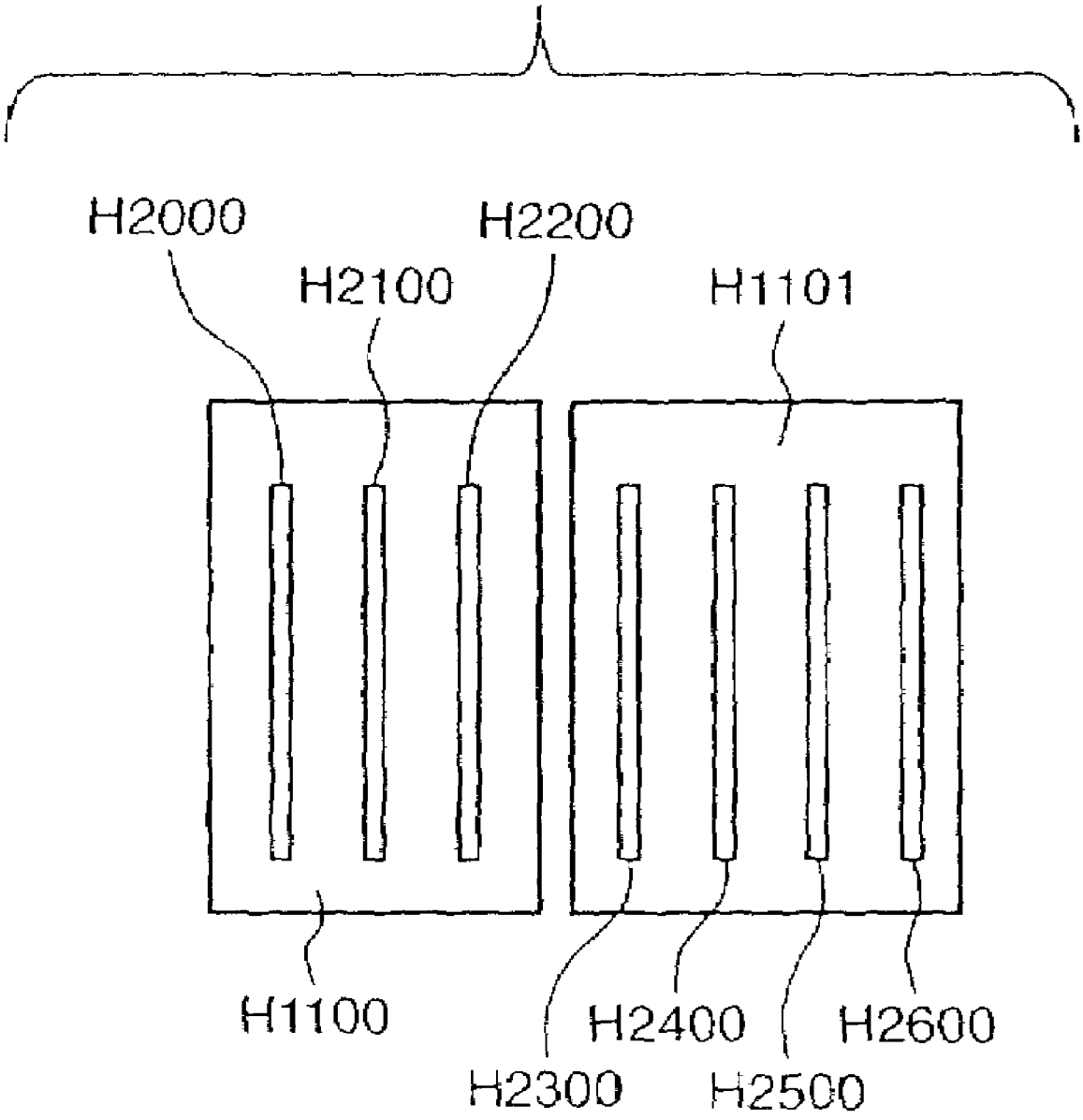
FIG. 10 is a front view showing a printing element board in the head cartridge used in the embodiment.
Figure 11A:
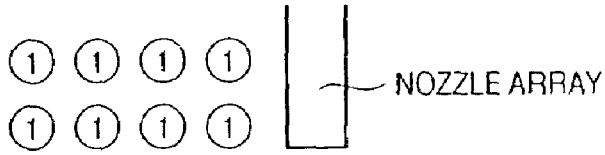
FIGS. 11A to 11E are views showing an example of the pattern of printed dots formed when 4-pass printing is performed.
Figure 11B:
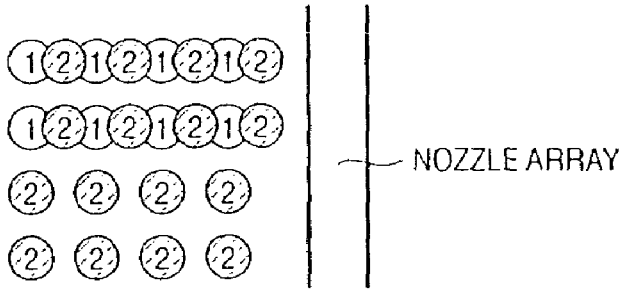
Figure 11C:
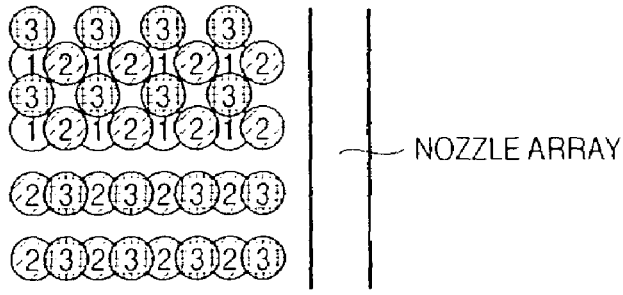
Figure 11D:
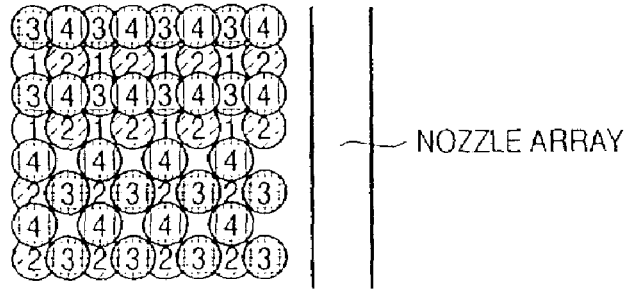
Figure 11E:
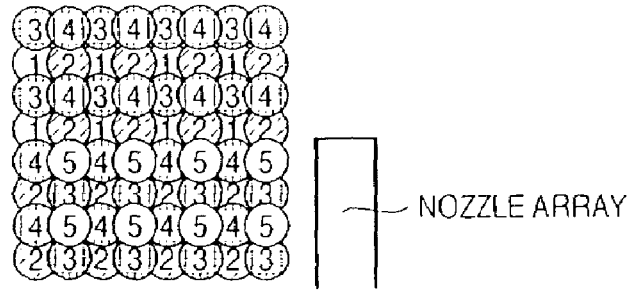

FIG. 10 is an enlarged front view for explaining the arrangements of the first printing element board H1100 and second printing element board H1101. Reference symbols H2000 to H2600 denote printing element arrays (to be also referred to as nozzle arrays) respectively corresponding to the different ink colors. The three nozzle arrays corresponding to three colors, i.e., nozzle array H2000 to which cyan ink is supplied, the nozzle array H2100 to which magenta ink is supplied, and the nozzle array H2200 to which yellow ink is supplied, are arranged on the first printing element board H1100. The nozzle arrays corresponding to four colors, i.e., the nozzle array H2300 to which black ink is supplied, the nozzle array H2400 to which red ink is supplied, the nozzle array H2500 to which green ink is supplied, and the nozzle array H2600 to which blue ink is supplied, are arranged on the second printing element board H1101.

Each nozzle array is comprised of 768 nozzles arranged at 1,200-dpi (dot/inch; reference value) intervals in the conveyance direction of a printing medium, and discharges ink droplets of about two picoliters. The opening area of each nozzle orifice is set to about 100 $\mu m^2$. The first printing element board H1100 and second printing element board H1101 are fixed on the first plate H1200 with an adhesive. Ink supply ports H1201 for supplying ink to the first printing element board H1100 and second printing element board H1101 are formed in the first plate H1200.

In addition, the second plate H1400 having opening portions is fixed on the first plate H1200 with an adhesive. The second plate H1400 holds the electric wiring board H1300 so as to electrically connect the electric wiring board H1300, first printing element board H1100, and second printing element board H1101 to each other.

The electric wiring board H1300 serves to apply electrical signals for discharging ink from the respective nozzles formed on the first printing element board H1100 and second printing element board H1101, and has electric wirings corresponding to the first printing element board H1100 and second printing element board H1101 and an external signal input terminal H1301 which is positioned on this electric wiring end portion and serves to receive electrical signals from the printing apparatus body. The external signal input terminal H1301 is positioned and fixed on the rear surface side of the tank holder H1500.

The channel forming member H1600 is fixed on the tank holder H1500, which holds the ink tank H1900, by ultrasound welding to form an ink channel H1501 extending from the ink tank H1900 and communicating with the first plate H1200.

The filter H1700 is provided on the ink-tank-side end portion of the ink channel H1501 engaged with the ink tank H1900 to prevent the entrance of dust. In addition, the seal rubber H1800 is mounted on the engaging portion with the ink tank H1900 to prevent the evaporation of ink from the engaging portion.

In addition, as described above, the tank holder unit comprising the tank holder H1500, channel forming member H1600, filter H1700, and seal rubber H1800 is coupled to the printhead H1001 comprising the first printing element board H1100, second printing element board H1101, first plate H1200, electric wiring board H1300, and second plate H1400 with an adhesive to form the printhead cartridge H1000.

(Correction of Conveyance Amount)

In this embodiment, correction of conveyance amounts in the two printing mode, i.e., 4-pass printing operation of completing printing by performing main scanning on a predetermined area of a printing medium four times and 8-pass printing operation of completing printing by performing main scanning eight times will be described.

In the printing apparatus of this embodiment, printing can be done with respect to an entire printing medium surface. However, in each of the two printing modes, an entire printing medium surface is divided into three types of areas, and the conveyance amount and printing operation are changed for each area.

Figure 16:
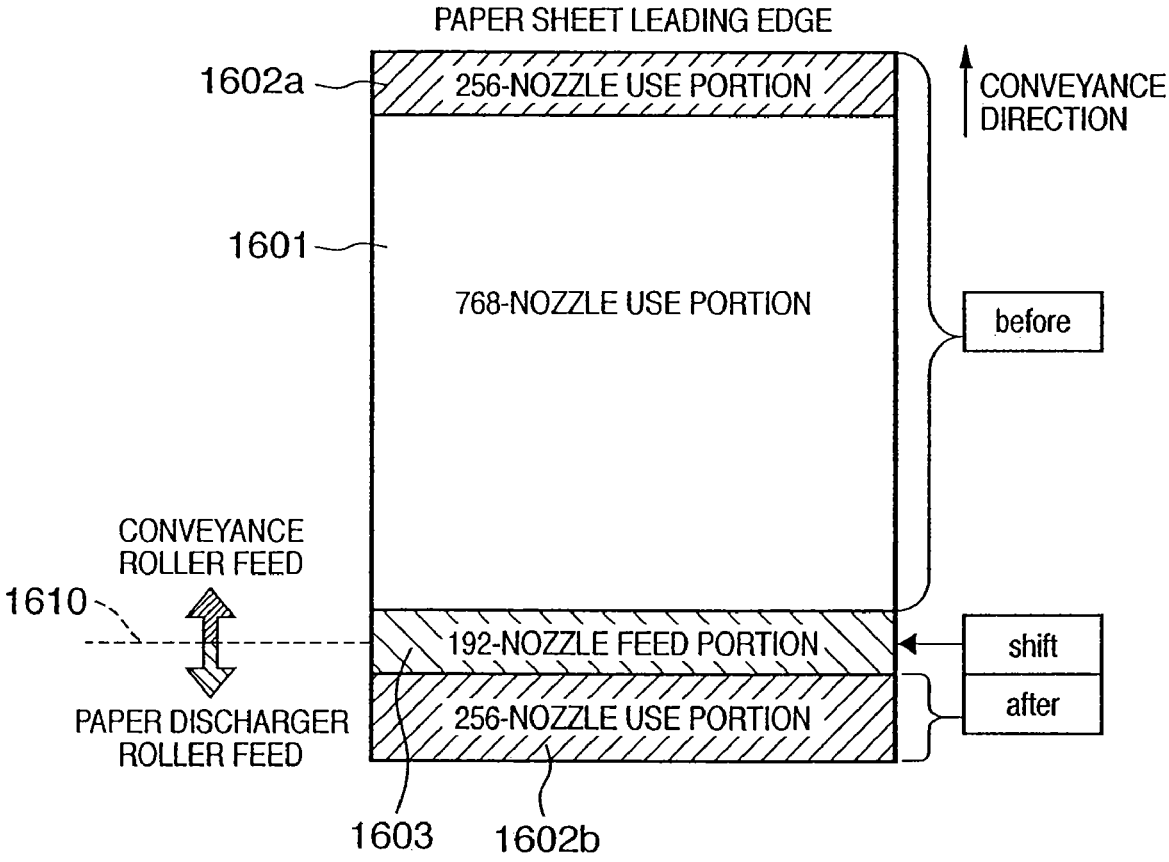
FIG. 16 is a view showing an example of how the area of a printing medium is divided according to the embodiment.

FIG. 16 is a view showing an example of how a printing medium surface is divided into three types of areas in this embodiment. FIGS. 17A to 17D are views for explaining the positional relationship between a printing medium and the conveyance means including the conveyance roller and the paper discharge roller in the process of conveying the printing medium. In this embodiment, the printing medium surface is divided into the areas depending on which roller is used for the conveyance of the printing medium in consideration of the frictional force between the conveyance roller M3060, the paper discharge roller M3110, and the printing medium.

Figure 17A:
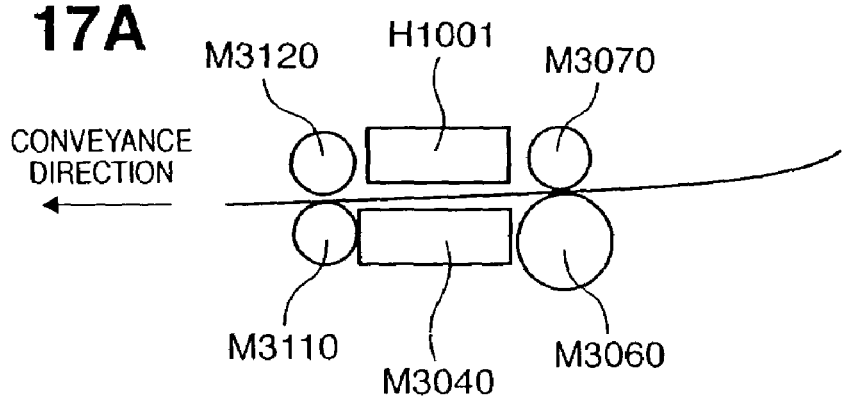
FIGS. 17A to 17D are views for explaining the positional relationship between a printing medium, a conveyance roller, and a paper discharge roller in this embodiment.

Referring to FIG. 16, reference numeral 1601 denotes an area into which the printing medium is conveyed by the two rollers, i.e., the conveyance roller M3060 and paper discharge roller M3110, as shown in FIG. 17A. With respect to the area 1601, printing is performed by using all 768 nozzles of the printhead H1001.

Figure 17B:
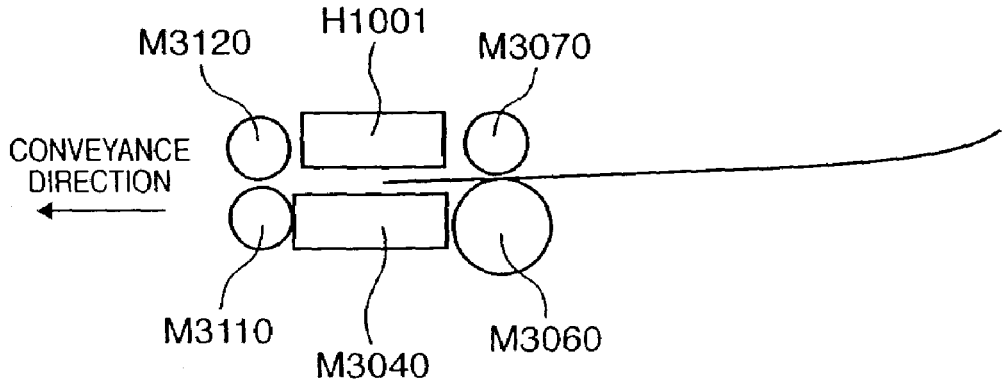
Figure 17C:
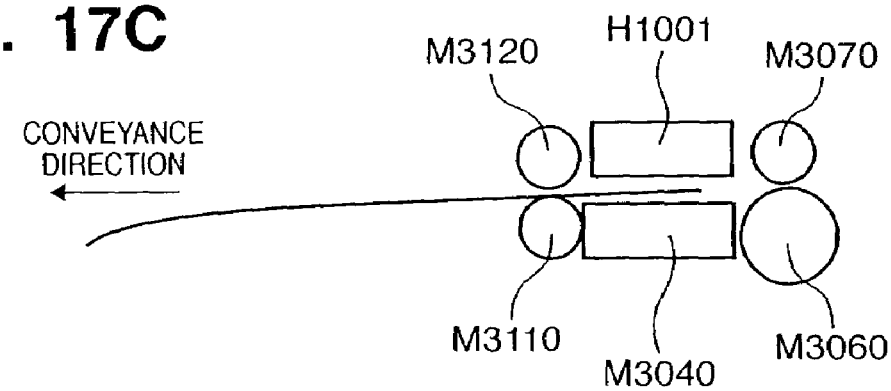

Referring to FIG. 16, reference numeral 1602*a* denotes an area into which the printing medium is conveyed by the conveyance roller M3060, as shown in FIG. 17B; and 1602*b*, an area into which the printing medium is conveyed by the paper discharge roller M3110, as shown in FIG. 17C. With respect to the two areas 1602*a* and 1602*b*, printing is performed by using 256 nozzles of the 768 nozzles of the printhead.

Referring to FIG. 16, reference numeral 1603 denotes an area including a position (1610 in FIG. 16) where the operation of conveying a printing medium is shifted from the operation of using the two rollers, i.e., the conveyance roller M3060 and paper discharge roller M3110, to the operation of using only the paper discharge roller M3110. In this area, the number of nozzles used for printing shifts from 768 to 256.

As described above, the two rollers, i.e., the roller M3060 on the upstream side in the conveyance direction and the roller M3110 on the downstream side in the conveyance direction are used in the following manner. A printing medium is conveyed first by using only the roller M3060 on the upstream side. When the leading edge of the printing medium reaches the roller M3110 on the downstream side, the printing medium comes into contact with the two rollers. Thereafter, after the trailing edge of the printing medium passes through the roller M3060 on the upstream side, the printing medium is conveyed by only the roller M3110 on the downstream side. Note that the flow of this conveyance can be roughly divided into two operations, i.e., conveyance operation in which the roller on the upstream side is used for conveyance and conveyance operation in which only the roller on the downstream side is used for conveyance.

Operation for 4-pass printing and 8-pass printing with respect to each area will be described below with reference to FIGS. 15A to 15F. Referring to FIGS. 15A to 15F, one square indicates 32 nozzles, and the number in "( )" indicates the number of times of main scanning.

Figure 15A:
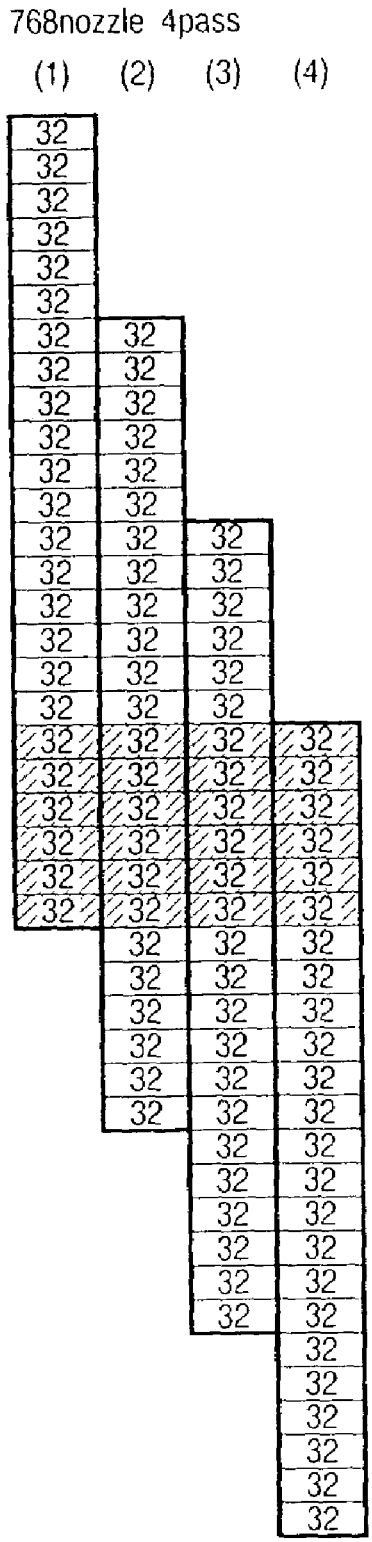

FIG. 15A is a view showing how 4-pass printing operation using all the 768 nozzles of the printhead is performed with respect to the area 1601 in FIG. 16. After printing is performed by the first main scanning operation, the printing medium is conveyed by a distance corresponding to 192 (=32×6) nozzles, and printing is performed by the second main scanning operation. Subsequently, conveyance of the printing medium by the distance corresponding to 192 nozzles and printing by main scanning are alternately performed, thereby completing an image in the area in which printing was performed by main scanning four times. Referring to FIG. 15A, the area completed by printing performed by main scanning four times is the hatched portion corresponding to 192 nozzles in the conveyance direction.

FIG. 15B is a view showing how 8-pass printing operation using all the 768 nozzles of the printhead is performed with respect to the area 1601 in FIG. 16. After printing is performed by the first main scanning operation, the printing medium is conveyed by a distance corresponding to 96 (=32×3) nozzles, and printing is performed by the second main scanning operation. Subsequently, conveyance of the printing medium by the distance corresponding to 96 nozzles and printing by main scanning are alternately performed, thereby completing an image in the area in which printing was performed by main scanning eight times. Referring to FIG. 15B, the area completed by printing performed by main scanning eight times is the hatched portion corresponding to 96 nozzles in the conveyance direction.

FIG. 15C is a view showing how 4-pass printing operation using 256 nozzles of the 768 nozzles of the printhead is performed with respect to the areas 1602*a* and 1602*b* in FIG. 16. Referring to FIG. 15C, each portion enclosed by the thick line indicates nozzles used for printing. After printing is performed by the first main scanning operation, the printing medium is conveyed by a distance corresponding to 64 (32×2) nozzles, and printing is performed by the second main scanning operation. Subsequently, conveyance of the printing medium by the distance corresponding to 64 nozzles and printing by main scanning are alternately performed, thereby completing an image in the area in which printing was performed by main scanning four times. Referring to FIG. 15C, the area completed by printing performed by main scanning four times is the hatched portion corresponding to 64 nozzles in the conveyance direction.

FIG. 15D is a view showing how 8-pass printing operation using 256 nozzles of the 768 nozzles of the printhead is performed with respect to the areas 1602*a* and 1602*b* in FIG. 16. Referring to FIG. 15D, each portion enclosed by the thick line indicates nozzles used for printing. After printing is performed by the first main scanning operation, the printing medium is conveyed by a distance corresponding to 32 nozzles, and printing is performed by the second main scanning operation. Subsequently, conveyance of the printing medium by the distance corresponding to 32 nozzles and printing by main scanning are alternately performed, thereby completing an image in the area in which printing was performed by main scanning eight times. Referring to FIG. 15D, the area completed by printing performed by main scanning eight times is the hatched portion corresponding to 32 nozzles in the conveyance direction.

Figure 15E:
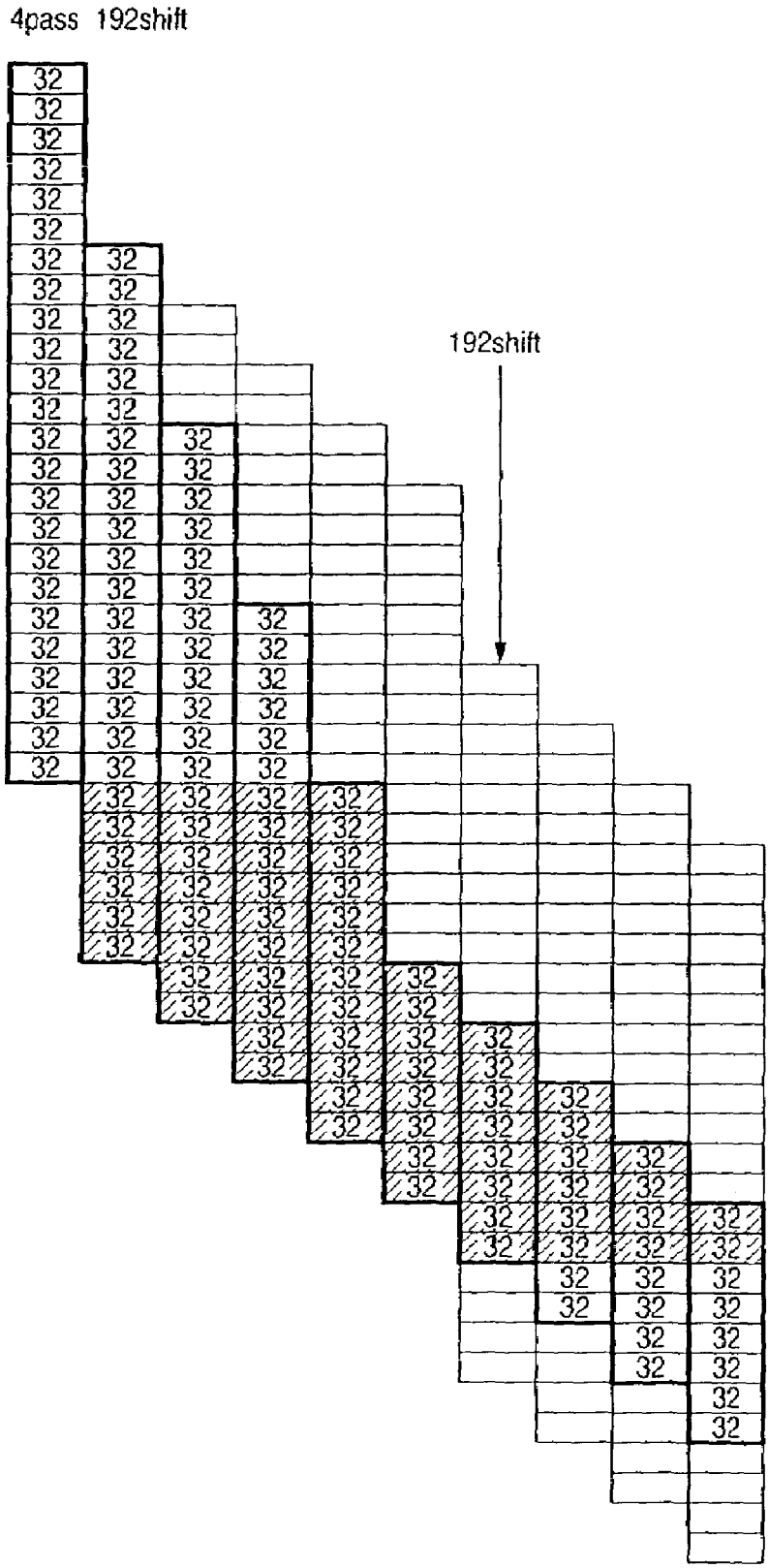
Figure 17D:
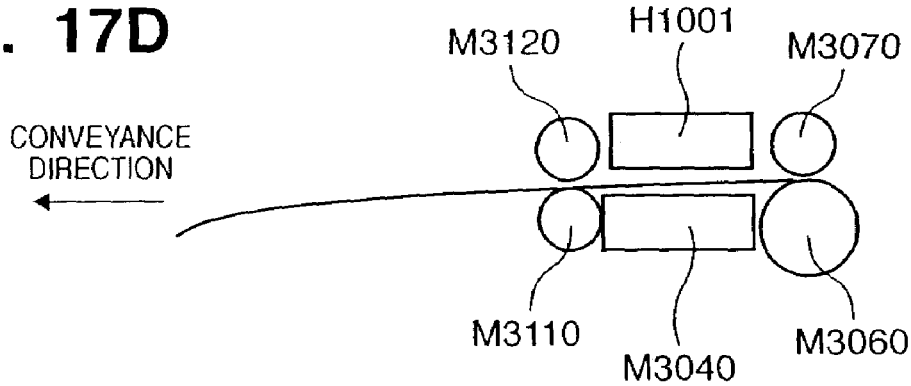

FIG. 15E is a view showing how 4-pass printing operation is performed with respect to the area 1603 in FIG. 16. Referring to FIG. 15E, each portion enclosed by the thick line indicates nozzles used for printing. As shown in FIG. 15E, the number of nozzles used for printing decreases by 128 for each main scanning operation from the third main scanning operation, and the state wherein all the 768 nozzles are used shifts to the state wherein 256 nozzles are used. Immediately after the number of nozzles used decreases to 256, the printing paper sheet is conveyed by a distance corresponding to 192 nozzles at the position indicated by the arrow in FIG. 15E (which corresponds to the position indicated by "1610" in FIG. 16 and will be referred to as a shift position hereinafter). As shown in FIG. 17D, this conveyance is conveyance performed at the timing when the trailing edge of the printing medium is released (separates from the conveyance roller) from the clamped state between the conveyance roller M3060 and the pinch roller M3070. This timing is detected as the timing when the printing paper sheet is conveyed by a predetermined amount after the detection of the trailing edge of the printing paper sheet by the PE sensor lever M3021. Subsequent conveyance is regularly performed as shown in FIG. 15C.

Figure 15F:
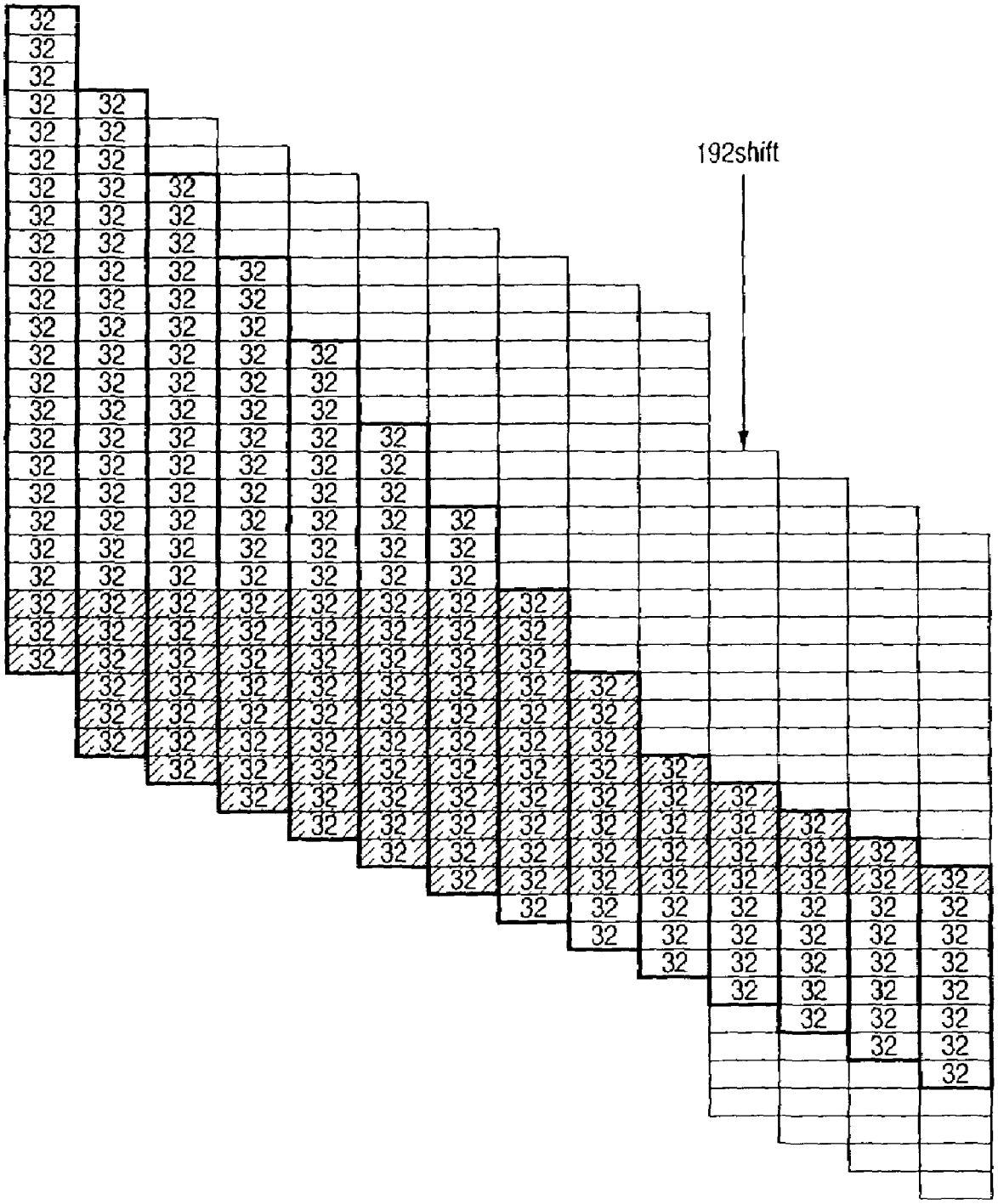

FIG. 15F is a view showing how 8-pass printing operation is performed with respect to the area 1603 in FIG. 16. Referring to FIG. 15F, each portion enclosed by the thick line indicates nozzles used for printing. As shown in FIG. 15F, the number of nozzles used for printing decreases by 64 for each main scanning operation from the third main scanning operation, and the state wherein all the 768 nozzles are used shifts to the state wherein 256 nozzles are used. As in the case described with reference to FIG. 15E, immediately after the number of nozzles used decreases to 256, the printing paper sheet is conveyed by a distance corresponding to 192 nozzles at the shift position indicated by the arrow in FIG. 15F. Subsequent conveyance is regularly performed as shown in FIG. 15D.

As described above, the mode of conveying a printing medium by using the two rollers, i.e., the conveyance roller and the paper discharge roller, shifts to the mode of conveying the printing medium by using only the paper discharge roller at a shift position 1610 in FIG. 16. As in this embodiment, in an arrangement designed to convey a printing medium by using two rollers, in general, the conveyance speed of the paper discharge roller is set to be equal to or higher than that of the conveyance roller, and the clamping force (frictional force) applied to the printing medium by the conveyance roller is set to be larger than that applied by the paper discharge roller in order to prevent the printing surface of the printing medium from having undulations. It can therefore be said that conveyance before the shift position (on the leading edge side) is mainly performed by the conveyance roller M3060.

In this case, the conveyance roller M3060 and paper discharge roller M3110 differ in their properties such as friction coefficient with respect to a printing medium and clamping force with respect to the printing medium. For this reason, when a conveyance amount is to be corrected, different correction amounts are required for the case wherein conveyance is mainly performed by the conveyance roller M3060 and the case wherein conveyance is performed by the paper discharge roller M3110. That is, correction of a conveyance amount (a parameter or coefficient) in the area (portion indicated by "before"=area 1601+area 1602*a*) before (on the leading edge side) the shift position 1610 in FIG. 16 needs to differ from that in the area (portion indicated by "after"=area 1602*b*) after the shift position (on the trailing edge side). The conveyance amount is also corrected in a different manner preferably in the area 1603, more preferably at the shift position 1610.

Figure 14:
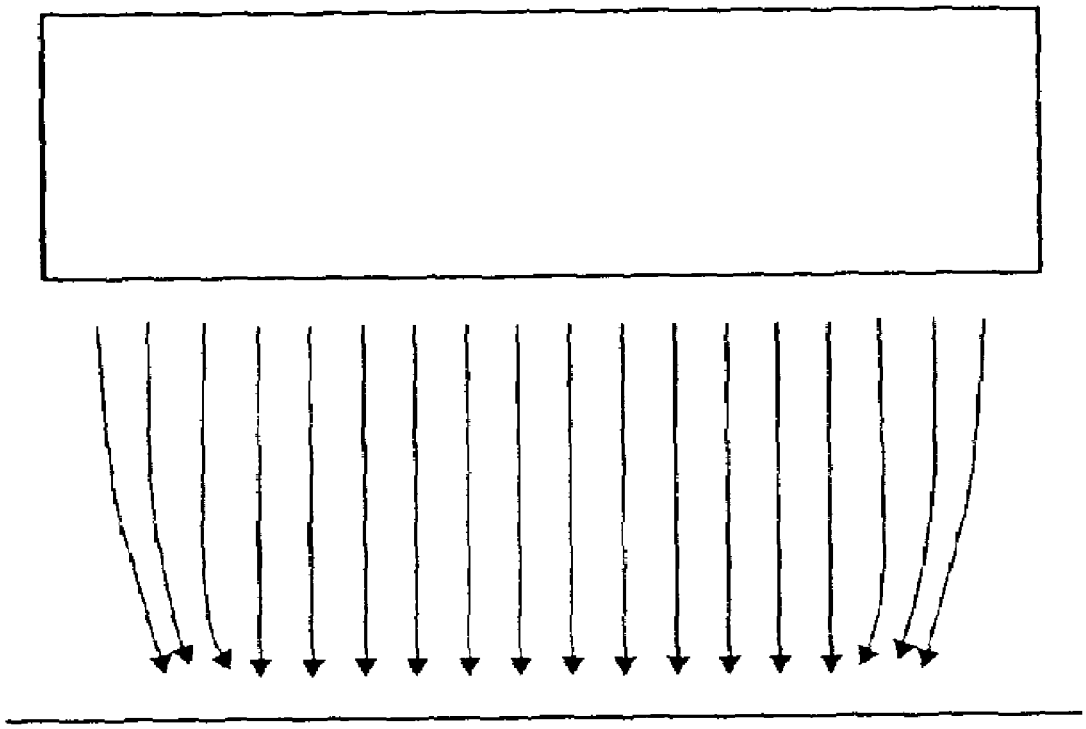
FIG. 14 is a schematic view showing how ink droplets are discharged from a printhead.

In consideration of the above description, a correction amount for a conveyance amount is calculated in the following manner on the assumption that the ink droplets discharged from all the nozzles are landed immediately below the nozzles without any consideration of the deviations of the ink landing positions of the ink droplets discharged from the end portions of a nozzle array due to an airflow. Letting α_before be a correction parameter on the leading edge side relative to the shift position, α_after be a correction parameter on the trailing edge side relative to the shift position, and α_shift be a correction parameter for conveyance at the shift position, correction amounts for one conveyance are represented by correction amount on leading edge side relative to shift position=conveyance amount before correction×α_before correction amount on trailing edge side relative to shift position=conveyance amount before correction×α_after correction amount for conveyance at shift position=conveyance amount before correction×α_shift In practice, however, as described with reference to FIG. 14, correction must be performed in consideration of the deviations of the ink landing positions of the ink droplets discharged from the end portions of a nozzle array due to an airflow. In this embodiment, in order to correct the deviation of an ink landing position due to an airflow, β is set as a parameter. Since the deviations of ink landing positions due to an airflow are influenced by the number of nozzles to be used, a parameter β_256 for a case wherein 256 nozzles are to be used and a parameter β_768 for a case wherein 768 nozzles are to be used must be provided as parameters. More preferably, a different parameter β_shift is set for conveyance of the 192-nozzle feed portion at the shift position.

In consideration of this, in this embodiment, final conveyance correction amounts for one conveyance are obtained by being classified into the following four patterns according to the position of a printing medium:

(1) for conveyance of the 256-nozzle use portion on the leading edge side relative to the shift position:

correction amount=conveyance amount before correction×α_before+β_256

(2) for conveyance of the 768-nozzle use portion on the leading edge side relative to the shift position:

correction amount=conveyance amount before correction×α_before+β_768

(3) for conveyance at the shift position:

correction amount=conveyance amount before correction×α_shift+β_shift (4) for conveyance on the trailing edge side relative to the shift position:

correction amount=conveyance amount before correction×α_after+β_256

Note that the correction parameters β_256, β_768, and β_shift are conveyance correction amounts each of which is added to the conveyance amount corrected by a correction parameter α per conveyance.

Conveyance amount correction processing at the time of image printing in the embodiment will be described with reference to the flowchart of FIG. 19.

Upon receiving a print instruction from a connected host device, the printing apparatus checks setting information, e.g., the type of printing medium, a conveyance path, the size of the printing medium, a grayscale mode, and printing quality, in step S1. The setting information is checked by referring to the information set by the user in the host device (printer driver) connected to the printing apparatus. With respect to the information of the type and size of a printing medium, if the printing apparatus is provided with a corresponding sensor, the detection result obtained by the sensor may be referred to.

It is determined in step S2 whether a conveyance instruction is received. If YES in step S2, the flow advances to step S3 to determine a printing position. If NO in step S2, the flow waits until a conveyance instruction is received. In step S3, it is determined whether the position of the printing medium to be conveyed is before (on the leading edge side) the shift position in FIG. 16, after (trailing edge side) the shift position, or at the shift position. If the position of the printing medium is before the shift position, the flow advances to step S4. If the position of the printing medium is after the shift position, the flow advances to step S5. If the position of the printing medium is at the shift position, the flow advances to step S6.

If the position of the printing medium is on the leading edge side relative to the shift position, it is further determined in step S4 whether the position of the printing medium corresponds to the area (1602*a*) in which 256 nozzles are used or the area (1601) in which 768 nozzles are used. If the position corresponds to the area in which 256 nozzles are used, the flow advances to step S8. If the position corresponds to the area in which 768 nozzles are used, the flow advances to step S7.

When it is determined that the position of the printing medium corresponds to one of the four divided areas, a conveyance amount is calculated in a corresponding one of steps S5 to S8. With regard to the correspondence with (1) to (4), a correction amount is calculated according to (1) in step S8; calculated according to (2) in step S7; calculated according to (3) in step S5; and calculated according to (4) in step S6.

In step S9, the printing medium is conveyed by the amount obtained by adding the conveyance correction amount calculated in one of steps S5 to S8 to the conveyance amount before the correction. In step S10, printing is performed by main scanning. It is determined in step S11 whether printing is complete. If NO in step S11, the processing in step S2 and the subsequent steps is repeated. If YES in step S11, this sequence is terminated.

Calculation of correction amounts concerning the following settings will be described as a specific example of calculating correction amounts by referring to examples of conveyance amount correction parameters in this embodiment shown in FIG. 18.

<Setting> printing medium: glossy medium 1 conveyance path: ASF medium size: A4 grayscale: OFF printing quality: 3 (in this case, the 4-pass printing mode is set)

As parameters for a correction amount, parameters which correspond to the settings checked in step S1 are invoked from the correction parameter table shown in FIG. 18. In the case of the above settings, therefore, the numerical values in the hatched portion in FIG. 18 are referred to, and correction amounts are calculated in steps S5 to S8 in FIG. 19 as follows:

(step S5):

correction amount=192 nozzles/32 nozzles×0+30=30

(step S6):

correction amount=64 nozzles/32 nozzles×1−6=−4

(step S7):

correction amount=192 nozzles/32 nozzles×(−2)+18=6

(step S8):

correction amount=64 nozzles/32 nozzles×(−2)−6=−10

In the example shown in FIG. 18, the parameter α is a converted value based on a 32-nozzle feed as the minimum unit of conveyance amount in the printing apparatus of this embodiment, and the parameter β is a converted value per scan. In addition, in this embodiment, since a correction amount is calculated in the unit of 115,200 dpi, both the parameters α and β are the values calculated by conversion to 115,200 dpi.

Referring to FIG. 18, since printing quality corresponds to the number of print passes, if the settings are the same except for printing quality, the values of the parameters α become common. For this reason, these parameters may be set as common parameters, although they may be separately provided and the same numerical values may be used as in this embodiment.

Referring to FIG. 18, if the grayscale mode is ON, 12 passes are selected, which are the number of passes larger than the maximum number of passes, i.e., eight passes, set when the grayscale mode is OFF, regardless of the printing quality setting. Therefore, the values of the parameters α are the same regardless of whether the grayscale mode is ON or OFF, different numerical values are set as the parameters β. Although the parameters α may be separately provided according to whether the grayscale mode is ON or OFF, and the same numerical values may be set, they may be set as common parameters.

In addition, referring to FIG. 18, 0s are set to all the parameters α at the shift position, and values are set to only the parameters β. This is because, these two parameters are used as a set only at the shift position, and hence are simplified. However, values may be set to the parameters α and β, respectively.

Referring to FIG. 18, parameters are separately set in correspondence with "ASF" and "U turn" as conveyance paths. This is because, the frictional resistance which a printing medium encounters varies depending on the conveyance path. If there are a plurality of conveyance paths, parameters corresponding to the types of conveyance paths are preferably prepared.

Referring to FIG. 18, parameters are separately set in accordance with the sizes of printing media. This is because the frictional force between the conveyance roller M3060 and a printing medium and the balance of the frictional resistance which the printing medium receives from the conveyance path vary depending on the size of the printing medium. In this embodiment, itemization is performed depending on whether the printing medium size is equal to or more than A4 or less than A4. However, more items may be provided in accordance with the sizes of printing media which can be handled by the printing apparatus.

In this embodiment, the parameters α are switched in accordance with the following three states:

the state wherein the printing medium is conveyed by the conveyance roller;

the state wherein the trailing edge of the printing medium separates from the conveyance roller; and the state wherein the printing medium is conveyed by only the conveyance roller. However, the parameters α may be switched more frequently in accordance with the following four states:

the state wherein the printing medium is conveyed by only the conveyance roller;

the state wherein the printing medium is conveyed by the two rollers, i.e., the conveyance roller and the paper discharge roller;

the state wherein the trailing edge of the printing medium separates from the conveyance roller; and the state wherein printing medium is conveyed by only the paper discharge roller.

In this embodiment, since the conveyance amount remains the same both in the state wherein the printing medium is conveyed by only the conveyance roller and the state wherein the printing medium is conveyed by the two rollers, i.e., the conveyance roller and the paper discharge roller, itemization is performed in accordance with the above three states. However, itemization is preferably performed in accordance with the above four states depending on the balance between the conveyance force of the conveyance roller and that of the paper discharge roller.

As described above, according to this embodiment, conveyance amount correction can be performed in accordance with not only mechanical frictional force but also the deviation of the printing position due to other factors such as the disturbance of an airflow due to a difference in the number of nozzles used for printing. This makes it possible to form a good image without any white and black stripes.

Other Embodiment

According to the above embodiment, in the serial type inkjet printing apparatus, the conveyance amount of a printing medium is corrected by using the first parameter for correcting the conveyance amount in accordance with a change in frictional force which is based on the positional relationship between the conveyance means including the conveyance roller and paper discharge roller and the printing medium, and the second parameter for correcting the conveyance amount in accordance with the disturbance of an airflow due to a difference in the number of nozzles used for printing. It should, however, be understood that any technique of correcting the conveyance amount by using at least two parameters corresponding to different factors is incorporated in the range of the present invention.

In this case, in addition to the first parameter for correcting the conveyance amount in accordance with a mechanical factor such as a change in frictional force, which has been conventionally used, the second parameter to be newly used may be a parameter for correcting the conveyance amount in accordance with a factor other than the number of nozzles used in the printhead exemplified in the above embodiment.

For example, in addition to the number of nozzles used in the printhead as a factor, the second parameter may be switched in accordance with one of the following factors:

(1) the distance between the printing medium and the printhead;

(2) the scan speed of the carriage;

(3) the amount of ink used for a printed image; and (4) the size of each dot to be discharged.

Factor (1) corresponds to a case wherein when the user can arbitrarily adjust the distance between the printing medium and the printhead, or when a parameter corresponding to the distance between the printing medium and the printhead which is unique to each printing apparatus is set at the time of shipment, the second parameter for correcting the conveyance amount is switched on the basis of the parameter value.

Factor (2) corresponds to a case wherein when the scan speed of the carriage can be changed, the second parameter for correcting the conveyance amount is switched on the basis of the scan speed.

Factor (3) corresponds to a case wherein when the amount of ink used for a printed image can be detected, the second parameter for correcting the conveyance amount is switched on the basis of the amount of ink used.

Factor (4) corresponds to a cases wherein when printed dots of a plurality of sizes can be discharged from the printhead, the second parameter for correcting the conveyance amount is switched on the basis of the dot size.

Each of factors (1) to (4) described above can be a factor which influences the amount of airflow produced or the influence of an airflow on discharged dots.

In addition, the arrangement and printing scheme of the printing apparatus are not limited to the serial type inkjet scheme, and any arrangement and printing scheme can be used as long as the printing apparatus is designed to print an image by alternately performing printing of an image and conveyance.

The method of correcting a conveyance amount by using two parameters are not limited to the method using a linear expression as in the above embodiment. Obviously, various methods and calculation methods can be used. Likewise, the values of the respective parameters corresponding to settings may be calculated in accordance with predetermined expressions instead of being stored or held in the form of a table as described above.

The present invention can be applied to a printing system comprising a plurality of devices or to an apparatus comprising a single device having an arrangement corresponding to a printing apparatus.

Figure 19:
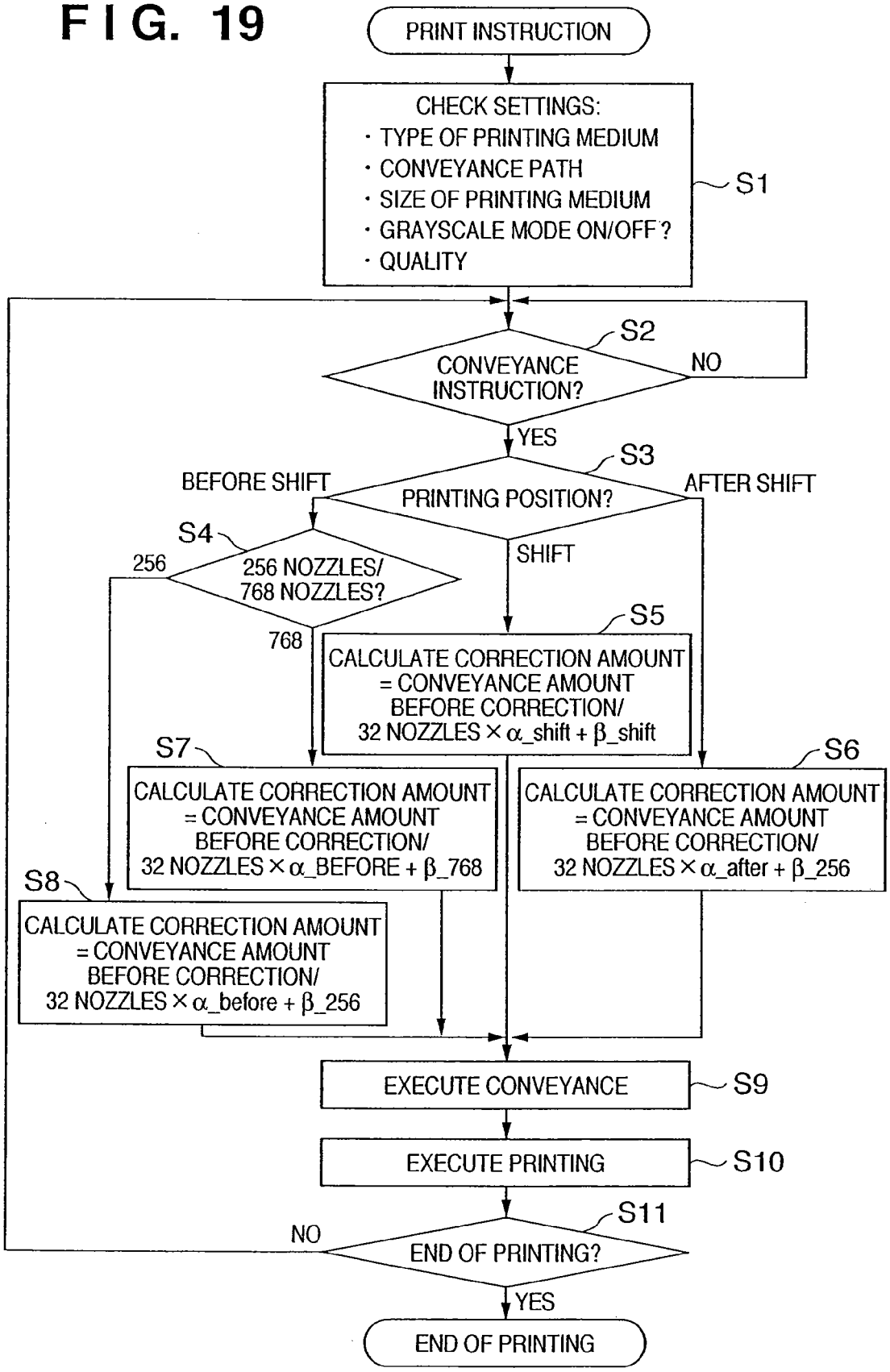
FIG. 19 is a flowchart showing conveyance amount correction processing in the embodiment.

Furthermore, the invention can be implemented by supplying a software program, which implements the functions of the foregoing embodiments (in the above embodiment, a program corresponding to the flowchart shown in FIG. 19), directly or indirectly to a system or apparatus, reading the supplied program code with a computer of the system or apparatus, and then executing the program code. In this case, so long as the system or apparatus has the functions of the program, the mode of implementation need not rely upon a program.

Accordingly, since the functions of the present invention are implemented by computer, the program code installed in the computer also implements the present invention. In other words, the claims of the present invention also cover a computer program for the purpose of implementing the functions of the present invention.

In this case, so long as the system or apparatus has the functions of the program, the program may be executed in any form, such as an object code, a program executed by an interpreter, or scrip data supplied to an operating system.

Example of storage media that can be used for supplying the program are a floppy disk, a hard disk, an optical disk, a magneto-optical disk, a CD-ROM, a CD-R, a CD-RW, a magnetic tape, a non-volatile type memory card, a ROM, and a DVD (DVD-ROM and a DVD-R).

As for the method of supplying the program, a client computer can be connected to a website on the Internet using a browser of the client computer, and the computer program of the present invention or an automatically-installable compressed file of the program can be downloaded to a recording medium such as a hard disk. Further, the program of the present invention can be supplied by dividing the program code constituting the program into a plurality of files and downloading the files from different websites. In other words, a WWW (World Wide Web) server that downloads, to multiple users, the program files that implement the functions of the present invention by computer is also covered by the claims of the present invention.

It is also possible to encrypt and store the program of the present invention on a storage medium such as a CD-ROM, distribute the storage medium to users, allow users who meet certain requirements to download decryption key information from a website via the Internet, and allow these users to decrypt the encrypted program by using the key information, whereby the program is installed in the user computer.

Besides the cases where the aforementioned functions according to the embodiments are implemented by executing the read program by computer, an operating system or the like running on the computer may perform all or a part of the actual processing so that the functions of the foregoing embodiments can be implemented by this processing.

Furthermore, after the program read from the storage medium is written to a function expansion board inserted into the computer or to a memory provided in a function expansion unit connected to the computer, a CPU or the like mounted on the function expansion board or function expansion unit performs all or a part of the actual processing so that the functions of the foregoing embodiments can be implemented by this processing.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priority from Japanese Patent Application No. 2004-245687 filed on Aug. 25, 2004, which is hereby incorporated by reference herein.

What is claimed is:

1. A printing apparatus which prints on a printing medium using a printhead having a plurality of nozzles for discharging ink, said apparatus comprising:

a conveyance unit having rollers for conveying the printing medium; and a correcting unit configured to correct a conveyance amount of the printing medium by said conveyance unit using a first parameter, corresponding to usage conditions of the rollers, that is changed in accordance with a position of the printing medium conveyed by said conveyance unit and a second parameter corresponding to a number of usage nozzles that is changed in accordance with the position of the printing medium.

2. The apparatus according to claim 1, wherein the first parameter is a correction amount corresponding to a minimum unit of conveyance amount among a plurality of conveyance amounts which can be used when the printing medium is conveyed, and the second parameter is a correction amount added to a conveyance amount per one time obtained using the first parameter.

3. The apparatus according to claim 1, wherein said conveyance unit comprises an upstream side roller provided on an upstream side of the printhead and a downstream side roller provided on a downstream side of the printhead, relative to a conveyance direction, and said correcting unit uses a different value of the first parameter for each of i) a case where the printing medium exists at a first position where the printing medium is conveyed by the upstream side roller and the downstream side roller, and ii) in a case where the printing medium exists at a second position where the printing medium is conveyed by the downstream side roller alone.

4. The apparatus according to claim 1, wherein the value of the first parameter is changed in accordance with a type of printing medium to be used.

5. The apparatus according to claim 1, wherein the value of the first parameter is changed in accordance with a size of printing medium to be used.

6. The apparatus according to claim 1, further comprising a plurality of conveyance paths, wherein the value of the first parameter is changed in accordance with the conveyance path to be used.

7. The apparatus according to claim 1, wherein the value of the second parameter is changed in accordance with at least one of a distance between the printing medium and the printhead, a scan speed of the printhead and a type of printing medium.

8. The apparatus according to claim 1, wherein the value of the second parameter is changed in accordance with a number of scans of the printhead necessary to complete printing of a predetermined area on the printing medium.

9. A printing apparatus which prints on a printing medium by performing scans of a printhead relative to the printing medium, the printhead having a plurality of nozzles for discharging ink, said apparatus comprising:

conveyance means for conveying the printing medium between the scans of the printhead, said conveyance means having first and second rollers, the first roller being located on an upstream side of an area to which the scans of the printhead are performed, and the second roller being located on a downstream side of the area;

determining means for determining a position of the printing medium conveyed by said conveyance means; and correcting means for correcting a conveyance amount of the printing medium by said conveyance means, using a first parameter and a second parameter corresponding to the position based on a determination result of said determining means, wherein the first parameter is a parameter, corresponding to usage condition of the first and second rollers, that is changed in accordance with the position, and the second parameter is a parameter corresponding to a number of usage nozzles that is changed in accordance with the position.

10. The apparatus according to claim 9, wherein said determining means determines the position of the printing medium conveyed based on where the printing medium exists among a first position where the printing medium is conveyed by the first roller and the second roller, a second position where the printing medium is conveyed by the second roller alone, and a third position between the first position and the second position, and said correcting means uses a different value of the first parameter for each of i) a case where the printing medium exists at the first position, ii) a case where the printing medium exists at the second position, and iii) in a case where the printing medium exists at the third position.

11. A printing method which prints on a printing medium using a printhead having a plurality of nozzles for discharging ink, said method comprising:

a conveyance step of conveying the printing medium using rollers; and a correcting step of correcting a conveyance amount of the printing medium in said conveyance step, using a first parameter, corresponding to usage conditions of the rollers, that is changed in accordance with a position of the printing medium conveyed in said conveyance step and a second parameter corresponding to a number of usage nozzles that is changed in accordance with the position of the printing medium.

12. A printing method which prints on a printing medium by performing scans of a printhead having a plurality of nozzles for discharging ink, said method comprising:

a conveyance step of conveying the printing medium between scans of the printhead using first and second rollers, the first roller being located on an upstream side of an area to which the scans of the printhead are performed, and the second roller being located on a downstream side of the area;

a determining step of determining a position of the printing medium conveyed in said conveyance step; and a correcting step of correcting a conveyance amount of the printing medium in said conveyance step using a first parameter and a second parameter corresponding to the position based on a determination result of said determining step, wherein the first parameter is a parameter, corresponding to usage condition of the first and second rollers, that is changed in accordance with the position, and the second parameter is a parameter corresponding to a number of usage nozzles that is changed in accordance with the position.

* * * * *